US009593855B2

(12) United States Patent
Moro et al.

(10) Patent No.: US 9,593,855 B2
(45) Date of Patent: Mar. 14, 2017

(54) CONTROL DEVICE FOR GAS TAPS

(71) Applicant: ELTEK S.p.A., Casale Monferrato (Alessandria) (IT)

(72) Inventors: Marco Moro, Casale Monferrato (IT); Paolo Savini, Casale Monferrato (IT)

(73) Assignee: ELTEK S.p.A., Casale Monferrato (Alessandria) (IT)

( * ) Notice: Subject to any disclaimer, the term of this patent is extended or adjusted under 35 U.S.C. 154(b) by 272 days.

(21) Appl. No.: 14/403,910

(22) PCT Filed: May 24, 2013

(86) PCT No.: PCT/IB2013/054302

§ 371 (c)(1),
(2) Date: Nov. 25, 2014

(87) PCT Pub. No.: WO2013/175441

PCT Pub. Date: Nov. 28, 2013

(65) Prior Publication Data

US 2015/0153048 A1 Jun. 4, 2015

(30) Foreign Application Priority Data

May 25, 2012 (IT) ..... TO2012A0460

(51) Int. Cl.
*F24C 3/12* (2006.01)
*F23N 5/10* (2006.01)
(Continued)

(52) U.S. Cl.
CPC ..... *F24C 3/126* (2013.01); *F23N 5/107* (2013.01); *F23N 5/203* (2013.01); *H01H 19/025* (2013.01)

(58) Field of Classification Search
CPC ..... F24C 3/126; F23N 5/107; F23N 5/203; H01H 19/025
(Continued)

(56) References Cited

U.S. PATENT DOCUMENTS 5,575,638 A * 11/1996 Witham ..... F23N 5/203 126/39 BA
5,813,320 A * 9/1998 Frasnetti ..... F24C 3/126 126/39 G
(Continued)

FOREIGN PATENT DOCUMENTS

DE 10 2006 022326 11/2007
WO WO 2010/134040 11/2010
WO WO 2011/096902 8/2011

OTHER PUBLICATIONS

International Search Report for PCT/IB2013/054302, mailed Nov. 6, 2013.
(Continued)

*Primary Examiner* — Sean Michalski
(74) *Attorney, Agent, or Firm* — Nixon & Vanderhye P.C.

(57) ABSTRACT

A control device for gas appliances comprises:
a manual-control element (12, 22);
a circuit arrangement that includes control elements, electrical-interconnection elements, detection elements configured for detecting actuation of the manual-control element (12, 22) and supplying corresponding signals to the control elements; and
a supporting structure that can be associated in a stationary way with respect to a gas tap (10), wherein the supporting structure includes a first part of stationary structure (21) that defines a housing for at least part of the circuit arrangement, the first part of structure being in particular designed for being housed within a body (3) of the gas appliance.
(Continued)

The control elements are designed for counting the time, the circuit arrangement includes display elements (D'), and the supporting structure includes a second part of stationary structure (43, 44) associated to or projecting from the first part of structure (21) and configured for supporting the display elements (D) in a fixed or not angularly rotatable position, where in particular, in an installed condition of the device (20), the second part of structure (43, 44) projects on the outside of the body (2, 3) of the gas appliance (1).

18 Claims, 23 Drawing Sheets

(51) Int. Cl.
*F23N 5/20* (2006.01)
*H01H 19/02* (2006.01)

(58) Field of Classification Search
USPC ..... 99/332, 327, 328, 333, 337, 341
See application file for complete search history.

(56) References Cited

U.S. PATENT DOCUMENTS 6,705,533 B2 * 3/2004 Casey ..... F23N 1/002 236/1 E
7,255,100 B2 * 8/2007 Repper ..... F23N 1/005 126/39 BA
7,467,639 B2 * 12/2008 Watson ..... F23N 1/002 137/1
8,100,121 B2 * 1/2012 Clauss ..... F24C 3/126 126/25 R
8,353,281 B2 * 1/2013 Oberhomburg ..... F23N 1/002 126/39 BA
8,766,116 B2 * 7/2014 Barrena ..... F23N 1/007 200/17 R
2006/0151996 A1 * 7/2006 Lang ..... F16L 9/006 285/197
2006/0234177 A1 * 10/2006 Yu ..... F23N 5/22 431/86
2011/0126823 A1 * 6/2011 Barritt ..... F23N 1/002 126/39 BA
2012/0055764 A1 3/2012 Lekmine et al.
2013/0199512 A1 * 8/2013 Cetintas ..... F23N 5/24 126/39 BA
2014/0047944 A1 * 2/2014 Camli ..... F24C 3/126 74/553
2014/0150773 A1 * 6/2014 Daughtridge, Jr. ..... F24C 3/124 126/39 E
2014/0252880 A1 * 9/2014 Seigler ..... H03K 17/94 307/116
2015/0198336 A1 * 7/2015 Koch ..... F23N 5/245 126/39 E
2016/0061454 A1 * 3/2016 Wei ..... F23N 1/005 99/332

OTHER PUBLICATIONS

Written Opinion of the International Searching Report for PCT/IB2013/054302, mailed Nov. 6, 2013.

* cited by examiner

Fig. 10
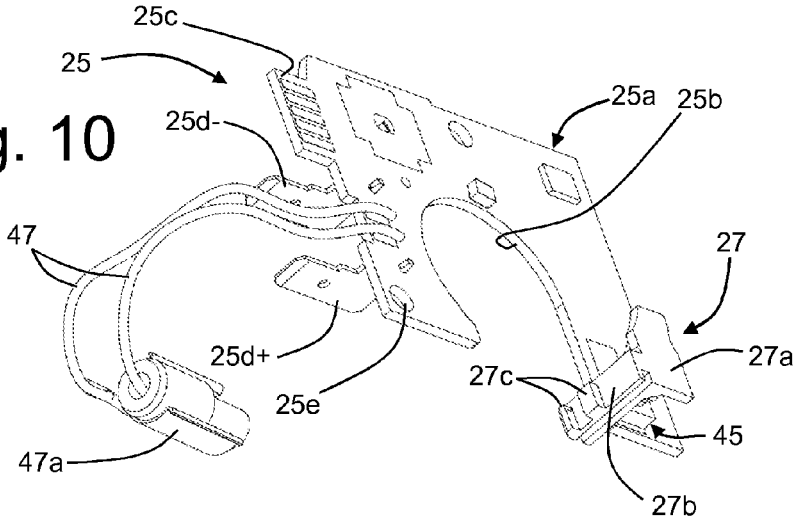
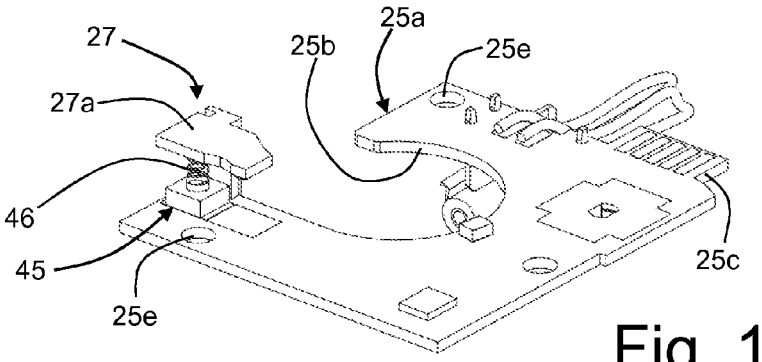
Fig. 11
Fig. 12
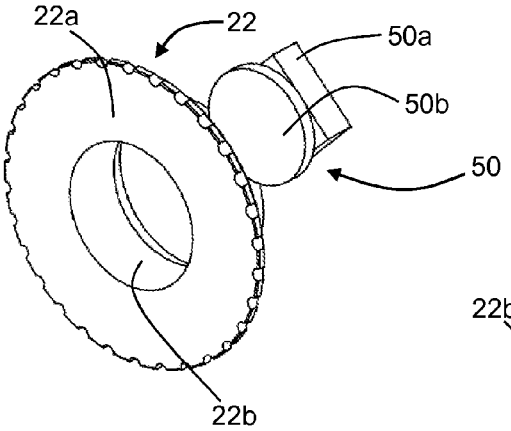
Fig. 13
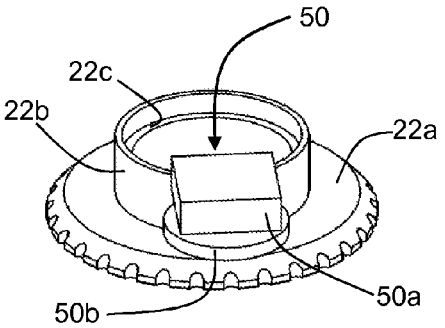

Fig. 14
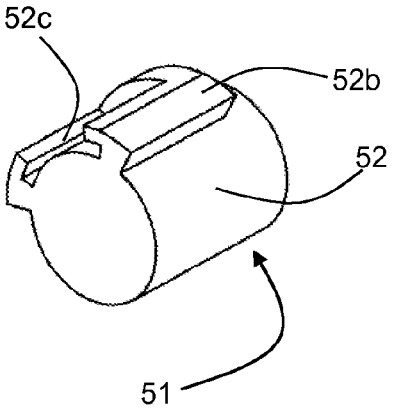
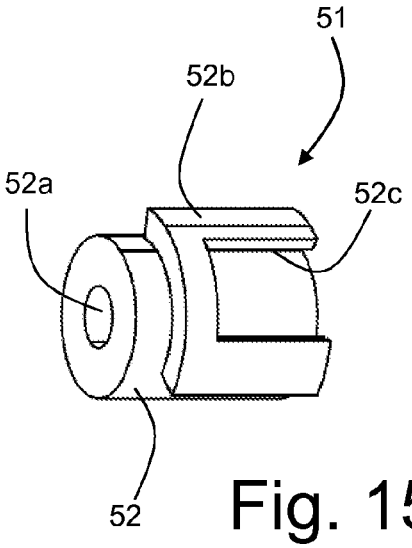
Fig. 15
Fig. 16
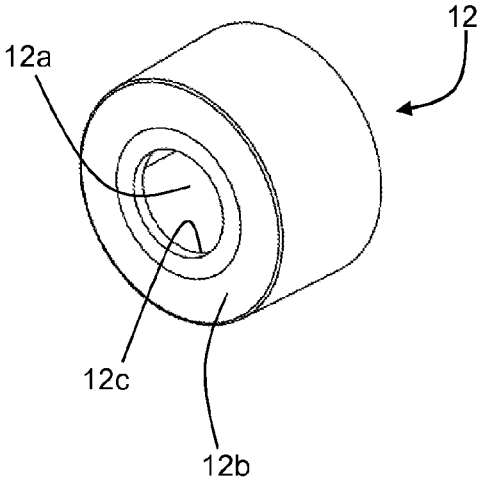
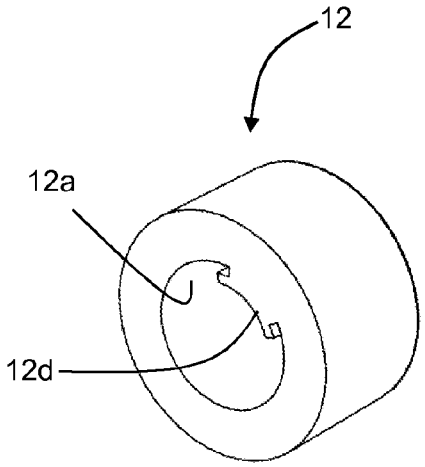
Fig. 17

47
47a
26
25c
25a
25d-
25d+
41a
40h
41c
25a"
41
41b
25a'
D
60
60
63
42
40
62
51'
70
61
68
74
65
12'
12d
64
22
12
69

CONTROL DEVICE FOR GAS TAPS

This application is the U.S. national phase of International Application No. PCT/IB2013/054302, filed 24 May 2013, which designated the U.S. and claims priority to IT Application No. TO2012A000460, filed 25 May 2012; the entire contents of each of which are hereby incorporated by reference.

FIELD OF THE INVENTION

The present invention relates to devices for control and/or detection of the supply of gas for appliances having one or more gas burners or similar flame generators. More in particular, the invention regards a control and/or detection device having a timing function, for example for enabling setting and/or adjustment and/or detection of a desired time interval of supply of gas to a respective burner or the like and/or for controlling and/or detecting the time that the burner remains lit.

PRIOR ART

Gas taps commonly used in cooking appliances and the like have a body, generally made of metal, provided with an inlet for connection to a gas-supply line, and an outlet for connection to a duct for delivery of the gas to the burner controlled by the tap. Mounted within the tap body are means for adjusting the flow of gas, constituted, for example, by an open/close element or partializer that can be position-adjusted via a maneuvering rod and/or further levers or internal mechanisms. The rod projects axially from a proximal end of the tap body and is designed to turn about its own axis, for the purposes of the aforesaid flow adjustment. Coupled to the maneuvering rod is a knob: a rotation imparted manually on the knob hence brings about rotation of the rod and consequent flow adjustment.

Provided within the tap body is a safety valve, which can be kept in the respective open condition by an electromagnet, the valve being of the open/closed type, for enabling or preventing, respectively, the flow of gas to the burner. The electromagnet is supplied via a thermo-electric generator, typically constituted by a thermocouple connected to a corresponding attachment or electrical connector of the tap body. The opposite end of the thermocouple, i.e., its sensitive part or hot junction, is installed in the proximity of the burner controlled by the tap. When the burner is lit, the sensitive part of the thermocouple generates an electromotive force (e.m.f.) in response to the heat generated by the flame on the burner, which determines a current that supplies the electromagnet of the safety valve, such as to keep the open/close element of the latter (associated to a movable core attracted by the electromagnet) in the respective open condition, countering the action of a spring.

Basically, as long as the burner is lit, the thermocouple generates a current that enables the electromagnet to keep the valve open; when the burner is turned off manually, or goes out accidentally, the electrical supply to the electromagnet ceases and the valve closes, forced in this direction by the aforesaid spring so as to prevent passage of gas between the inlet and the outlet of the tap.

For the aforesaid reasons, the rod of the tap is able to translate along its own axis, in a direction of actuation, against the action of elastic means inside the tap body. This axial displacement can be obtained by pushing the knob of the tap and turning it. With this movement there occurs both an initial opening of the safety valve and the flow of gas to the burner, and the knob is kept in the pressed condition until the flame is lit on the burner. As has been said, in the presence of the flame, the thermocouple generates the current, which, via the electromagnet, keeps the valve in the open condition. Hence, after ignition of the flame, the user can release the knob.

Operatively associated to the tap there may also be a gas-lighter system, for generating sparks in the proximity of the burner in order to cause ignition of the flame. This system usually comprises an electrical circuit that includes electrodes, generated between which are the aforesaid sparks following upon an electrical discharge. In some gas appliances, the lighter system is activated by exploiting the configuration of the tap, and especially the possibility of its rod translating axially. Consequently, by pressing the knob of the tap after turning it at least slightly, in addition to determining initial opening of the safety valve and flow of gas to the burner, the lighter system is also activated.

For this purpose, generally associated to the rod of the tap is an actuation element, which, in the course of axial displacement of the rod, causes switching of a microswitch of a normally open type, belonging to the electrical circuit of the lighter system. The microswitch may be of a type commonly available on the market for various uses and is anchored directly to the body of the tap, which has for this purpose at least one threaded hole for a corresponding fixing screw.

To a gas tap of the type referred to previously there may be associated a device for timed control of the supply of gas to a corresponding burner, i.e., to enable setting of a desired time interval of operation of the burner.

Timer devices are known, operatively coupled to a respective gas tap and having a corresponding knob, substantially coaxial to the knob of the tap. Via the knob of the device, a user can set a desired time interval of supply and then light the burner. Upon expiry of the time interval set, the device brings about closing of the safety valve inside the tap so as to interrupt supply of gas to the burner. For this purpose, the known device integrates a control circuit arrangement that basically includes timer means, which can be set via the corresponding knob, and controllable electrical switching means, connected between the thermocouple and the electromagnet of the safety valve of the gas tap. In a possible embodiment, the circuit arrangement of the known device also includes controllable electrical switching means connected in series to the circuit of the lighter system, designed to perform the functions of the microswitch previously referred to provided on taps of a traditional type.

Also known are devices in which there is envisaged the use of generic warning means, set within a casing of the device that is housed within the body of the appliance provided with the burner to be controlled. Associated to the emitters is a generic light guide for transmitting light radiation on the outside of the casing, in a region corresponding to a knob of the tap or to a ring nut of the device, for lighting up said elements and supplying to a user limited information on state of the device. In known solutions there is also envisaged the use of a panel display device, which is connected in common to various timer devices associated to the respective taps, but independent and installed in a remote position with respect thereto. The aforesaid panel display is designed to receive signals from the various timer devices and, given that it is substantially of an alphanumeric type, moreover enables supply of information on passage of time starting from ignition of the corresponding burner.

This solution is relatively inconvenient, for example when the timing function is active for a plurality of the devices associated to the taps. In this case, the user has to govern in a specific way display of the residual programming time of the device of interest by acting on the device itself or else on the panel display. Display of information for a number of devices on a single display complicates the control and data-communication logic. The possible simultaneous display of information on a number of devices complicates production of the display and increases the overall dimensions thereof. Problems of a practical nature, for example for manufacturers of electrical household appliances, derive also from the need to accommodate the display on the product, such as the panel of the cooking surface purposely prearranged.

SUMMARY OF THE INVENTION

The object of the present invention is to overcome one or more of the drawbacks referred to above and to provide a control device for gas taps, of the type referred to above, which comprises a display device that is convenient and reliable in use, as well as being compact and inexpensive to produce and easy and practical to install on the user appliance.

Another object of the present invention is to provide a control device for gas taps, of the type referred to above, designed to supply information and/or warnings in a clear and immediate way in order to facilitate use of the device itself and/or of the user appliance, and where possible operations of control will be extremely convenient and practical for a user.

The above and other objects still, which will emerge more clearly hereinafter, are achieved according to the present invention by a control device, in particular with the timing function, having the characteristics referred to in the annexed claims. The claims form an integral part of the technical teaching provided herein in relation to the invention.

BRIEF DESCRIPTION OF THE DRAWINGS

Further purposes, characteristics, and advantages of the present invention will emerge clearly from the ensuing detailed description and from the annexed drawings, which are provided purely by way of explanatory and non-limiting example and in which:

FIGS. 10 and 11 are perspective views, from different angles, of a circuit arrangement of the device of FIGS. 6 and 7;

FIGS. 12 and 13 are perspective views, from different angles, of a control member of the device of FIGS. 6 and 7, with a corresponding angular-position sensor;

FIGS. 14 and 15 are perspective views, from different angles, of a transmission member of the device of FIGS. 6 and 7;

FIGS. 16 and 17 are perspective views, from different angles, of a control means of the device for a tap used in combination with the device of FIGS. 6 and 7;

DESCRIPTION OF PREFERRED EMBODIMENTS OF THE INVENTION

Figure 1:
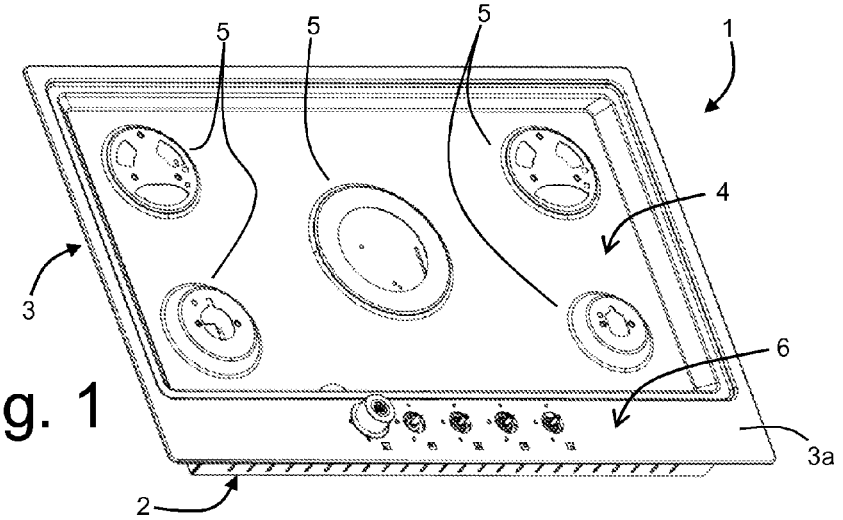
FIG. 1 is a schematic perspective view of a gas-supplied appliance provided with a control device according to a possible embodiment of the invention.

FIG. 1 is a schematic representation of a gas-supplied appliance 1, equipped with a control device according to the present invention, hereinafter also defined for ready reference as "timer device".

In the example illustrated, the appliance 1 is a cooking appliance, and more in particular a cooking hob, of a general conception in itself known, of which just the elements useful for an understanding of the invention are represented. The timer device according to the invention may in any case also be used in other types of appliances provided with at least one gas burner, or similar flame generator, controlled via a respective tap, such as for example boilers, in particular for domestic heating.

Figure 2:
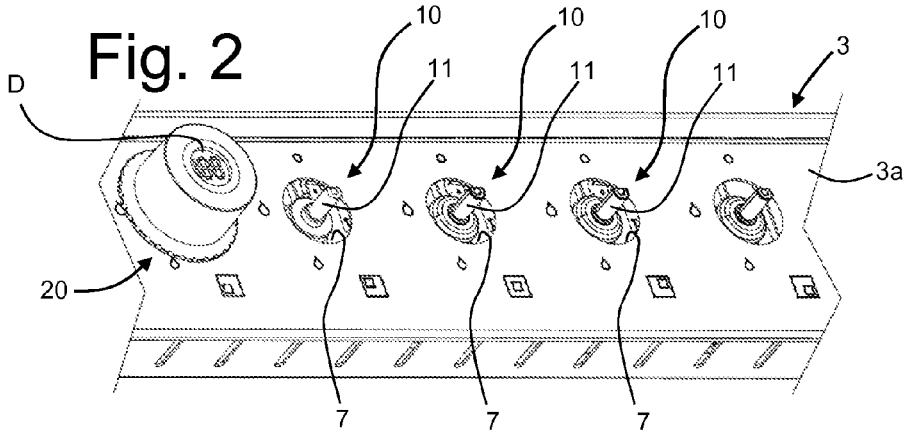
FIG. 2 is a detail of FIG. 1.

The structure or body of the appliance 1 includes a lower box 2, which is fixed to an upper lid 3, defining a working area 4 identified in which are various cooking locations 5, as well as a command area 6. As per the known art, mounted within the structure of the appliance 1 are various functional components, amongst which—for what is of interest herein—taps for control of the supply of gas to the burners (not represented in detail herein)—of the various cooking locations 5. For this purpose, as may be noted in FIG. 2, a wall 3*a* of the lid 3 has—in a position corresponding to the command area 6—a series of through openings 7, projecting from each of which is the actuation rod 11 of the tap 10 of a corresponding burner. As may be appreciated from FIG. 3, the taps 10 are fixed within the structure of the appliance, in positions corresponding to the openings 7, all according to the known art. The taps 10 are of a type in itself known, in particular of the type described in the introductory part of the present description.

By way of example, in the example of embodiment represented, only one of the taps 10 is equipped with a timer device provided according to the invention, designated as a whole by 20. Once again by way of example, the four taps 10 of FIG. 3 not equipped with the device 20 are provided with traditional pushbutton microswitches, some of which are designated by MS, of the type traditionally belonging to the electrical circuit of a gas-lighter system. The microswitches MS are fixed with a screw S to the corresponding tap body.

Figure 4:
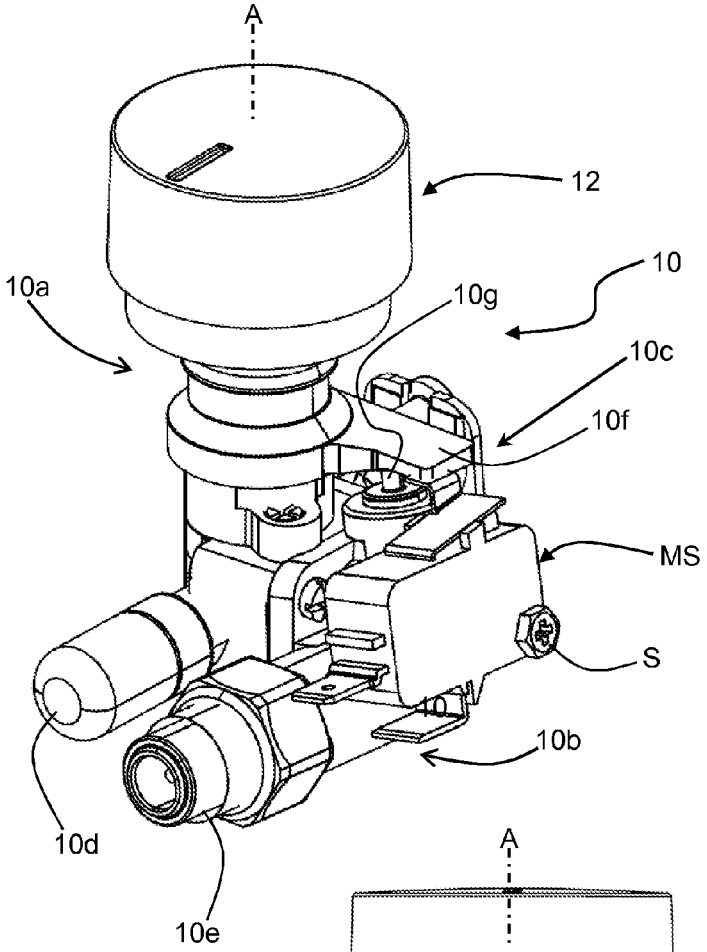
FIGS. 4 and 5 are a perspective view and a view in side elevation of a known gas tap, provided with a switch forming part of a gas-lighter system of a gas-supplied appliance.
Figure 5:
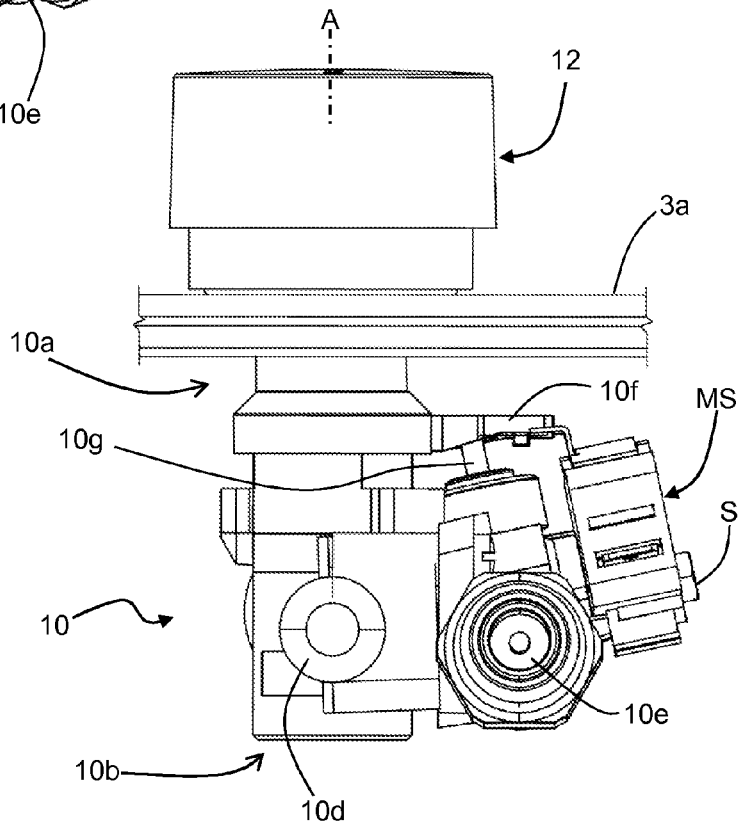

FIGS. 4 and 5 exemplify a gas tap 10 of a type generally known on the market, as described in the introductory part of the present description. In general terms, the body of the tap 10 has a front portion 10*a*, projecting from which is the corresponding rod 11—here not visible in so far as it is engaged by the corresponding control knob 12, but which extends along the axis designated by A—and a rear portion 10*b*, provided in which are the inlet and the outlet for the gas, as well as the attachment for the thermocouple, where the front portion 10*a* has overall dimensions generally small with respect to the rear portion 10*b*. In FIGS. 4 and 5 the inlet and outlet for the gas are designated by 10*c* and 10*d*, whilst the attachment for the thermocouple is designated by 10*e*. In the case of the tap 10 illustrated also visible is an actuation element 10*f*, operatively constrained to the corresponding control rod to move therewith only in an axial direction, according to a technique well known in the sector. In practice, the element 10*f* is coupled to the rod so that, when this is turned about the axis A, the element 10*f* remains substantially stationary. When, instead, the rod 11 is translated axially along the axis A, the element 10*f* follows the axial movement of the rod. With said axial movement—and in particular when the rod is pressed by means of the knob 12—the element 10*f* pushes a shaft 10*g*, which brings about opening of the safety valve of the tap 10, as explained previously, said valve being then kept open thanks to the corresponding electromagnet, once the flame of the burner has been lit. When the user releases the knob 12, the actuation element 10*f* follows the movement of axial return of the control rod.

In traditional applications, as has been said, the actuation element 10*f* can be advantageously exploited also for causing switching in closing of a microswitch MS forming part of the lighter system, which is fixed to the body of the tap via the screw S, typically a microswitch connected to the a.c. voltage of a domestic electrical wiring system, such as a 220-V a.c. voltage.

Figure 6:
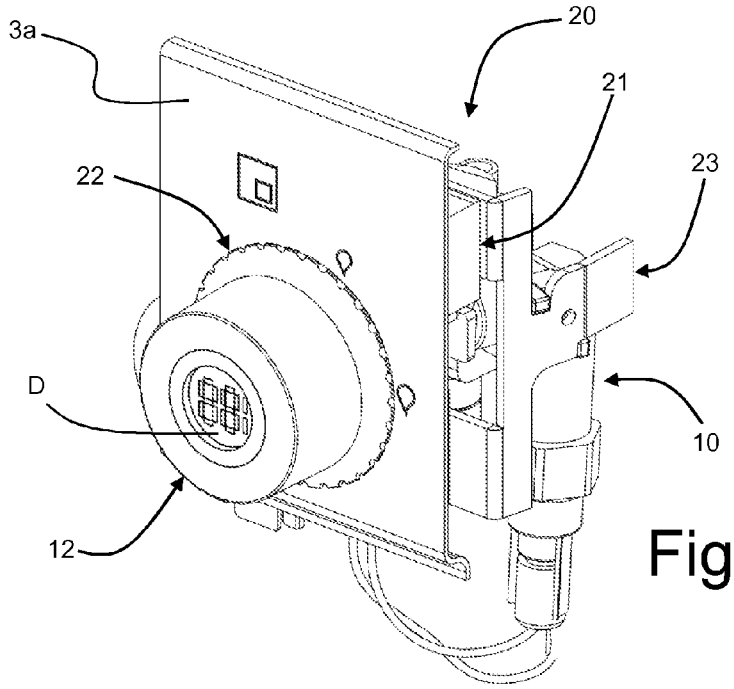
FIG. 6 is a partial and schematic perspective view of a control device according to the invention, in a condition where it is installed on the appliance.
Figure 7:
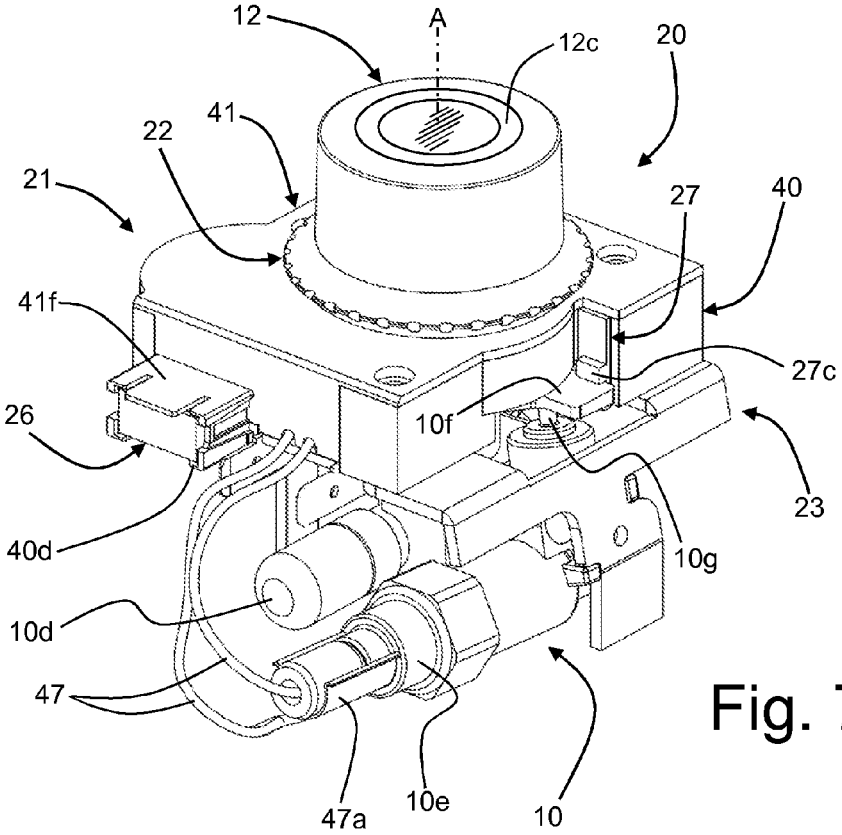
FIG. 7 is a partial and schematic perspective view of the device of FIG. 9, but from a different angle and with a part of the appliance removed.

Visible in FIGS. 6 and 7 is a timer device 20 according to a possible embodiment of the invention. The supporting structure of the device 20 comprises a boxlike casing 21—for housing at least part of a corresponding circuit arrangement—as well as a control means 22 for setting at least one time of supply of gas to the burner controlled by the corresponding tap 10. In the condition where the device 20 is assembled on the appliance (FIG. 6), the casing 21 is housed within the structure 2-3, and hence in a concealed or non-accessible position, with just the control means 22 accessible from outside. Preferably, the casing 21 is set between a rear portion of the tap 10 and the wall 3*a* of the structure provided with the opening projecting from which is at least the actuation rod 11. Very preferably, the casing 21 is shaped so as to receive through it at least part of a front portion of the tap 10. For this purpose, in a preferred embodiment, the casing 21 is shaped so as to define a passage, inserted within which is the aforesaid front portion of the tap. As will be seen hereinafter, in one embodiment, various components of the device 20 (such as the ones designated hereinafter by 25, 40 and 41) are purposely configured for determining the presence of the aforesaid passage.

In a preferred embodiment, the control means 22 comprises a ring nut member or knob, which is operatively set between a knob 12 for manual actuation of the rod 11 of the tap 10 and the outer face of the wall 3*a*. In the assembled condition of the device 20, the control means 22—hereinafter referred to for simplicity as "ring nut"—is mounted movable, in particular angularly movable or rotatable, and is basically coaxial to the knob 12. In one embodiment (not represented), the ring nut 22 may also be axially movable, for example in order to bring about switching of control elements of the tap 10 and/or of the device 20. Of course, the shape and proportions of the ring nut 22 as represented, with respect to the knob 12, are merely indicative.

The device 20 envisages electrical or electronic visual-warning means. In an advantageous embodiment, these means, designated by D in the figures, are operative in a position corresponding to the knob 12, preferably in a central or axial position. In the first embodiment exemplified herein, the means D comprise a small display, in particular a numeric or alphanumeric display, preferably a LED (light-emitting diode) display or an LCD (liquid-crystal display). In a particularly advantageous embodiment of the invention, the aforesaid visual-warning means D are in a substantially stationary position with respect to the knob 12: in other words, even turning the knob 12 for adjustment of the flow of gas, the position of the display D does not change, in particular, with respect to the user appliance, to the advantage of convenience of reading information by a user.

In a particularly advantageous embodiment of the invention, the aforesaid visual-warning means D are in a substantially stationary position with respect to the ring nut 22: in other words, even if the ring nut 22 is turned or moved, the position of the display D does not change.

In a preferred embodiment, the ring nut 22—which may possibly function as light guide for performing also functions of light warning—and the display D represent, along with the knob 12, the only components of the device 20 that are visible and/or accessible from outside the structure of the appliance 1.

Figure 3:
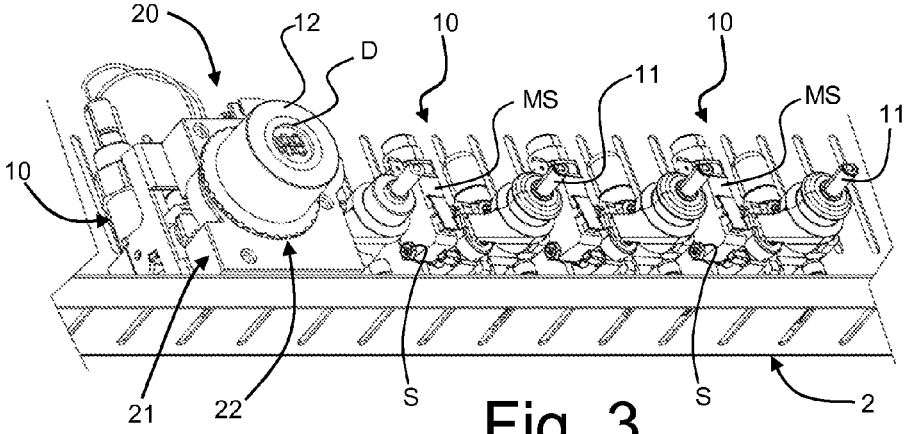
FIG. 3 is a view similar to that of FIG. 2, but with a part of the appliance removed.

In a preferred embodiment, the structure of the device 20 has means for coupling the casing 21 to the body of the tap 10. In the example illustrated, the coupling means comprise a bracket 23, which is preferably made of metal or thermoplastic material and is operatively set between the casing 21 and the body of the tap 10. Advantageously, fixing of the bracket 23 can be carried out by exploiting at least one screw that is normally associated to the body of the tap 10, for example a screw used for its fixing to the structure of the appliance 1 or a screw S that, according to the known art, is used for fixing the microswitch MS referred to previously (FIGS. 3 and 4). Also fixing of the casing 21 to the bracket 23 can be obtained with screws, or else via mutual coupling and engagement means, such as engagement reliefs or teeth that fit in respective seats.

In variant embodiments (not represented), the bracket 23 may be associated to or integrated with the casing 21, for example by overmoulding plastic material of a part of the casing 21 on the bracket 23, or shaping a part of the body of the casing 21 like a bracket, in order to perform directly functions of coupling to the body of the tap. In other possible embodiments (not represented), the casing 21 of the device may be fixed to the structure of the appliance 1, via a purposely provided bracket or else directly.

Figure 8:
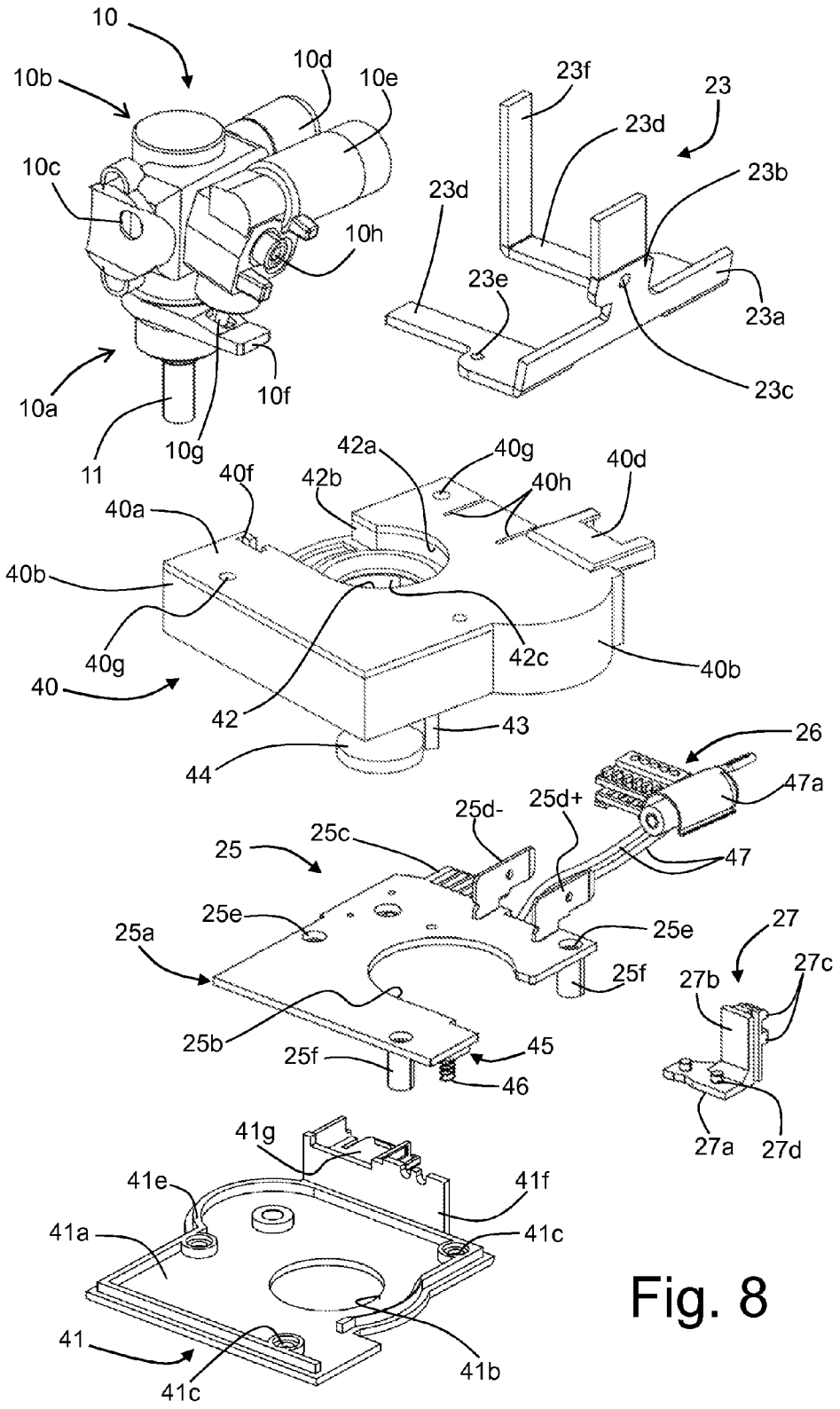
FIGS. 8 and 9 are exploded views, from different angles, of some parts of the device of FIGS. 6-7.
Figure 9:
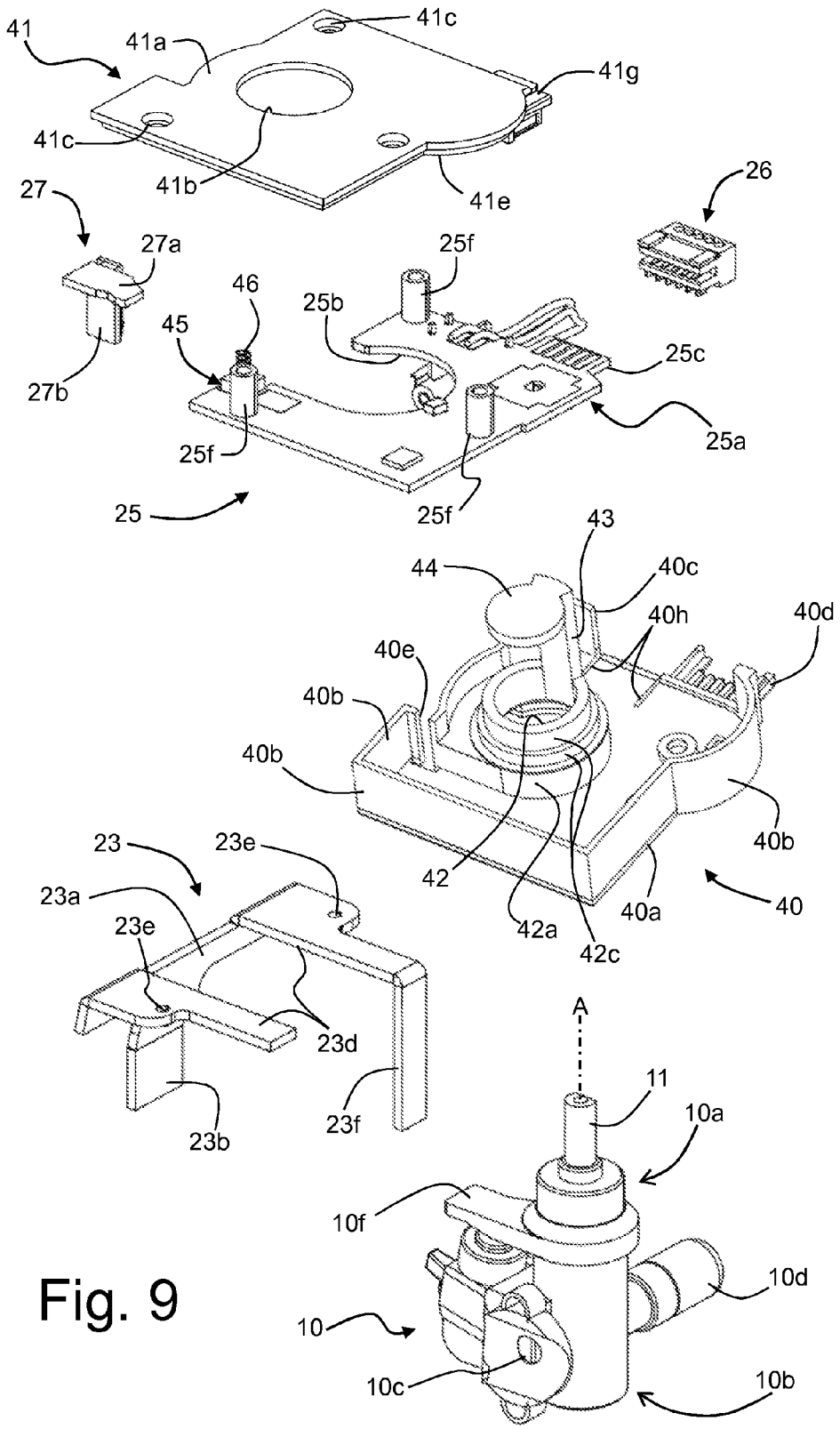

FIGS. 8 and 9 show, from different angles, the components of the timer device according to one embodiment of the invention. Visible in these figures are the tap 10, the mounting bracket 23, a first part 40 of the casing 21, a circuit arrangement 25 that equips the device, a connector 26 belonging to an external wiring system (not represented), a control or motion-transmission element 27 for a switching means of the circuit arrangement 25.

As already mentioned, the tap 10 may be of a commercially available type in itself known, as described in the introductory part of the present description with reference to FIGS. 4 and 5.

In traditional applications, as has been said, the actuation element 10*f* may advantageously be exploited also for causing switching in closing of the microswitch MS forming part of the lighter system. As will be seen, in a particularly advantageous embodiment of the invention, the circuit arrangement of the device 20 includes a switching means, which performs also the functions of the aforesaid microswitch MS provided according to the known art. In the case of use of the timer device according to this embodiment, as exemplified here, the traditional microswitch MS may be omitted, and the screw S normally used for its fixing (FIGS. 3 and 4) may be exploited for fixing the bracket 23 to the body of the tap 10.

A possible embodiment of the bracket 23 is visible in FIGS. 8 and 9. In this non-limiting example, the bracket 23 is made of metal and has a longitudinal member 23*a* rising from which is a first upright part 23*b*, provided with a hole 23*c* for the passage of a screw (not represented), for example for engagement in an internal screw 10*h* provided on the body of the tap 10. This internal screw may advantageously be the one usually provided for the screw S for fixing the microswitch MS provided according to the known art. Branching off from the longitudinal member 23*a* are two cross members 23*d*, generally parallel to one another and substantially orthogonal with respect to the upright 23*a*, provided with respective holes 23*e* for securing the casing 21, for example via screws. At least one of the cross members 23*d* can have an upright terminal part 23*f*, which is preferably substantially orthogonal to the cross member itself, which functions as contrast or resting element with respect to the structure of the appliance 1. It should be noted that the shape illustrated for the bracket 23 is provided merely by way of example, other shapes evidently being possible, which are preferably defined according to the shape of the tap and/or of the casing 21 and/or to the structure of the appliance.

The part 40 of the casing defined hereinafter for simplicity as "container" is substantially box-shaped and made of plastic material, with a bottom wall 40*a* and peripheral walls 40*h* that define a cavity or a seat for housing at least part of the circuit arrangement 25. Preferably, one of the peripheral walls 40*b* closes only partially the corresponding side of the container 40, thus defining a side opening 40*c* (FIG. 9). At said side opening 40*c*, from the bottom wall 40*a* an appendage 40*d* projects outwards, aimed at providing a first part of a connector body, visible as a whole in FIG. 7, fitted within which is the connector 26.

In a preferred embodiment, one of the peripheral walls 40*b* has an opening or gap 40*e* (FIG. 9), the function of which will be clarified hereinafter, to which there preferably corresponds a slit 40*f* (FIG. 8) defined in the bottom wall 40*a*. In one embodiment, such as the one represented, the bottom wall 40*a* is also provided with holes 40*g* for fixing the casing to the bracket 23, as well as a pair of slits 40*h*, which are preferably generally parallel and in a position set alongside with respect to the appendage 40*d*.

The casing 21 of the device 20 is configured for coupling with the body of the tap 10, and for this purpose has a passage, in which a corresponding part of the tap may be received passing through it. For example, in the embodiment illustrated, the bottom wall 40*a* has a through opening 42, which is preferably, but not necessarily, substantially circular. Preferably, moreover, the container 40 defines a hollow portion, projecting within the corresponding cavity, where the opening 42 is located. Very preferably, moreover, the container 40 also defines an external recess, for housing partially, and with possibility of movement, the actuation element 10*f* of the tap 10.

In the embodiment illustrated, the bottom wall 40*a* and the peripheral wall 40*b* that has the gap 40*e* define together, within the container 40, the aforesaid hollow portion 42*a*, having an outer profile that is at least in part cylindrical. As may be seen in FIG. 8, moreover, a part of the bottom wall 40*a* defines the aforesaid external recess 42*b*, between the opening 42 and a respective wall 40*b*, in particular the one provided with the gap 40*e*.

Once again with reference to the example of embodiment illustrated, and as may be seen in FIG. 9, from the hollow portion 42 there rises at least one further cylindrical portion 42*c*, which also delimits part of the passage 42.

The device 20, in particular its casing 21, then includes supporting means for the display D. In a preferred embodiment, these supporting means belong to the fixed structure of the device 20. In the case exemplified, the supporting means are associated to the casing 21, these supporting means possibly being integrated in or fixed or welded to at least part of the casing 21. More in particular, and as may be noted in particular in FIG. 9, from the bottom wall of the container 40—and especially from the cylindrical portion 42*c*—there rises at least one upright lateral part 43, having at the upper end a supporting and/or fixing wall 44 for the display, substantially set in cantilever fashion. In the example illustrated, the upright part 43 has a generally curved profile in cross section, according to the passage 24, and also the wall 44 has a generally round a peripheral profile.

As will emerge more clearly hereinafter, the container 40 and the lid 41 of the casing 21 prevalently form a first part of the stationary structure of the device, which houses at least part of the circuit arrangement 25 and is designed for installation within the body 2, 3 of the appliance 1. The walls 43 and 44 form, instead, a second part of the stationary structure, which projects from the aforesaid first part of structure and is configured for supporting the display means D in a fixed, or not angularly rotatable, position and where, in the condition where the device 20 is installed, the second part of structure projects on the outside of the body 2, 3 of the appliance 1. The second part of the stationary structure is preferably configured for enabling a more convenient installation and/or positioning of the display means D, in particular, with respect to the tap and/or the appliance 1.

With reference also to FIGS. 10 and 11, the circuit arrangement 25 preferably includes a printed-circuit board (PCB), designated by 25*a*, which is at least partially housed within the casing 21 and mounted on which are electrical and/or electronic components, connected to tracks (not represented) made of electrically conductive material defined on the circuit board 25*a*. Illustrated in the figures are only the components useful for an understanding of the invention, other electronic components being, however, possibly present, such as active or passive components or microcontroller circuits or memories.

In one embodiment, the circuit board 25*a* has a respective passage 25*b* that surrounds at least in part the passage 42 of the casing 21. In the example of embodiment, the passage of the circuit board 25*a* is in the form of an opening or slot 25*b* having a profile at least in part similar to or congruent with that of the opening 42 of the bottom wall 40*a* of the container 40 and/or of the corresponding hollow portion 42*a*, 42*c*, and the circuit board 25*a* is mounted in a position generally close to the bottom wall 40*a*. In the example, the slot 25*b* extends as far as an edge of the circuit board 25*a* and has at least a corresponding portion shaped like an arc of circumference. In other embodiments, the passage of the circuit board 25*a* may be circular, such as a hole, for example if the portion 42*a*, 42*c* is generally cylindrical or if it is absent.

The specific embodiment of the control circuit provided on the circuit board 25*a* may comprise—in general terms—components described in WO 2010134040, for performing the functions described in said document and/or other specific functions envisaged according to the present invention. An example of circuit will in any case be described hereinafter with reference to FIG. 23. For what is of specific interest herein, in one embodiment, an end or projecting portion 25*c* of the circuit board 25*a* provides a male electrical connector, the terminals of which are obtained from electrical tracks, in particular of an edge-connector or card-edge type, which, in the condition where the device 20 is assembled, is in a position corresponding to the appendage 40*d* of the container 40, provided for coupling with the external connector 26.

In one embodiment (not illustrated), the circuit arrangement 25 includes light-emitting means, which may comprise one or more emitters, for example of a LED type. Preferably, these emitter means are mounted on a face of the circuit board 25*a*—here defined as upper face—in the proximity of the passage of the casing 21. The emitters referred to above may be arranged at intervals apart around the slot 25*b*. Given that, in the example, the slot 25*b* extends as far as an edge of the circuit board 25*a*, the emitters 43 are arranged according to the profile of the arc-shaped part of the slot itself, preferably at substantially regular intervals. In such an embodiment, the ring nut 22 of the device 20 may be made of transparent or translucid material, or in any case of a material capable of transmitting on the outside of the casing 40 the light generated by the aforesaid LEDs, for example for the purposes of visual warning for a user.

The circuit arrangement 25 comprises detection or sensor means, for detecting the angular position of the ring nut 22 and supplying accordingly a signal representing a time interval of supply of the burner controlled by the tap 10. In the example, these sensor means include a stationary component, preferably mounted on the upper face of the circuit board 25*a*. In one embodiment, the sensor means are of a resistive type, such as a rotary potentiometer or trimmer, actuated by a corresponding part that may be set in rotation following upon a rotation of the ring nut.

In one embodiment, the signal for activation of the timing function of the device 20 is supplied to the circuit arrangement 25 by a control element. Preferably, this control element comprises a switching means, such as a pushbutton switch, preferably a low-power switch, for example, for voltages ranging between 1 V and 24 V, which can be switched following upon axial displacement of the rod 11 of the tap, for example, the switch designated by 45 in FIGS. 8-11. Advantageously, if the circuit of the device 20 is prearranged also for connection to a system for lighting the burners of the appliance 1, the signal generated by switching of the control element may also be used for governing the lighter system. In the example represented in FIGS. 8-11, the control element represented by the pushbutton switch 45 is provided on the upper face of the circuit board 25*a*. The switch 45 may be a double-contact switch, for example for the cases where the device 20 performs the timing function and the function of control of a lighter system, and it is desired to keep distinct from one another a command signal for the lighter system and a command signal for the timer function.

The motion-transmission element designated by 27 is configured for transmitting an axial movement of the control rod 11 of the tap 10 to the switch 45, and for this purpose is mounted movable on the casing 21, in particular in a slidable way. At least one part of the motion-transmission element 27 faces the outside of the casing 21 in order to be able to interact or couple with the actuation element 10*f* of the tap 10. In embodiments not represented, it is also possible to provide a motion-transmission element configured for direct coupling to the rod 11.

In the embodiment exemplified, the element 27 has a base part 27*a* and an upright part 27*b*, the latter being shaped for engaging slidably in a vertical direction in the gap 40*e* (FIG. 9) and in the slit 40*f* (FIG. 8). In effect, the element 27 is coupled to the container 40 so that its base part 27*a* overlies the pushbutton of the switch 45 in order to be able to cause switching thereof, in particular, via further interposed elastic means. The upright part 27*b* of the element 27 facing the outside of the casing 21 has a seat for engagement of the element 10*f* of the tap, said seat being here defined by two projections 27*c* (FIGS. 8 and 10) received between which is a part of the element 10*f*. In this way, the axial movement of the rod of the tap, due to pressure applied on the knob 12, brings about a corresponding vertical movement of the element 27 (downwards, as viewed in FIG. 7).

In a preferred embodiment, between the control element represented by the switch 45 and the corresponding actuation element 27, the aforesaid elastic means, or damping means, are provided, in particular having the function of operating the pushbutton of the switch 45 and compensating for possible tolerances of production and assembly and/or preventing risks of excessive stresses exerted by the element 27 on the switch 45. In the embodiment exemplified, and as may be appreciated, for example, in FIG. 11, said means comprise an elastic element 46, in particular a helical spring, operatively set between the element 27 and the pushbutton of the switch 45. In the example, one end of the spring 46 is fitted on a pin 27*d* (FIG. 8) projecting from the lower face of the head part 27*a* of the element 27, and the opposite end is engaged on the pushbutton of the switch 45. The spring 46 is calibrated so that, beyond a certain degree of compression thereof, it will transfer to the pushbutton of the switch 45 the force necessary for switching, said spring 46 being also able to absorb or compensate for possible excessive stresses.

In embodiments not represented, the damping function can be integrated directly in the motion-transmission element, for example by providing in its body an elastically deformable part, having spring functions.

The circuit arrangement 25 of the device includes first connection means for electrical connection to the electromagnet of the safety valve of the tap 10. Once again with reference to the example of FIGS. 8-11, connected to the circuit board 25*a* are electrical conductors or wires 47, represented schematically, for connection of the circuit of the device 20 to the electrical attachment or connector 10*e* of the tap 10, i.e., the attachment where the thermocouple is traditionally connected. Connected to the conductors or wires 47 of the arrangement 25 is a corresponding connector 47*a*, of a type complementary to the attachment 10*e* of the tap 10 and/or to the electrical connector of the electromagnet of the safety valve. Preferably, the connector 47*a* is of a type designed to perform the functions of connection proper to the traditional connectors for thermocouples used on taps of the type considered herein, in particular, a connector 47*a* of an axial type, or of a radial type, or of a Faston type.

In the example represented the connector 47*a* includes two generally coaxial parts, not indicated, and in particular a central part and a peripheral part. The central part, which is at least partially cylindrical, is made of electrically insulating material and defines at the centre an axial seat (FIG. 13), housed within which is a corresponding contact, such as a female electrical contact, connected to one of the conductors 47. The peripheral part, connected to the other conductor 47, is in the form of a shaped metal lamina, fitted on the central part and with a corresponding generally arched contact portion that surrounds at least partially the insulating central part, at a distance therefrom. The central part of the connector 47*a* can be inserted in the attachment or connector 10*e* for the thermocouple (see FIG. 7) so that in the corresponding axial seat there fits a male terminal, such as a terminal with central pin, of the attachment 10*e* (see, for example, FIG. 5), which thus electrically couples to the internal contact of the seat itself. The arched portion of the peripheral part of the connector 47*a*, by exploiting a certain elasticity thereof, bears, instead, upon an external cylindrical part of the attachment 10*e*.

In variants not represented, the conductors 47 may be absent, with the connector 47*a* connected or associated directly to the support of the circuit arrangement 25, with said connector, support, and casing of the device 20 appropriately shaped for enabling a connection to the connector 10*e* of the tap 10.

More in general, the electrical connectors, such as a first connector towards the electromagnet of the safety valve of the tap and a second connector towards the thermocouple, may be of the same type or else of different types: in the latter case, the timer device can function also as "adapter" between different connectors, i.e., between a thermocouple having a first type of connector and an electromagnet or safety valve of a gas tap having a second type of electrical connector, or else a timer 20 having a first connector 25*d* different from a second type of connector 47*a*.

The arrangement 25 likewise includes second connection means for electrical connection to the thermo-electric generator of the tap 10, i.e., the corresponding thermocouple. In the device 20 represented the conductors of the thermocouple—not represented—that equips the tap 10 are connected to the circuit arrangement 25*a* via fast-coupling connectors, which are preferably blade connectors, such as Faston connectors. In the example represented, projecting from the lower face of the circuit board 25*a* are two blade contacts 25*d*+ and 25*d*− (hereinafter, where not strictly necessary, designated simply by 25*d*), in particular of a male Faston type, which are generally L-shaped and are parallel to one another. The contacts 25*d* pass through the slits 40*h* of the bottom 40*a* of the container 40 so that their contact part projects outwards, providing an electrical connector of the device 20 for the thermocouple. On the aforesaid projecting part of the contacts 25*d* there may be fitted the connectors of the thermocouple, which in this case are of a female Faston type.

It will be appreciated that, in the example represented, the connection means proper to the thermocouple (here female Faston connectors) are of a different type from the connection means of the thermocouple provided by the tap (here the attachment 10*e* of a coaxial type): the device 20 consequently functions as "adapter", as explained above.

Note that the contacts 25*d* could be replaced by a cable with two conductors provided with a connector for a thermocouple.

The circuit board 25*a* preferably has positioning and fixing through holes 25*e*, designed to couple with reliefs 401 (not visible) of the bottom wall 40*a* of the container 40, said reliefs being axially hollow for receiving the screws that pass also into the holes 40*g* of the bottom 40*a* (FIG. 8). At the holes 25*e* bushings 25*f* are preferably mounted, on the upper face of the circuit board 25*a*, basically having the function of spacers and/or positioning elements with respect to the casing part designated by 41, defined hereinafter as "lid". The bushings 25*f* may possibly form part of the lid 41.

The lid 41 of the casing, made of plastic material, has a respective bottom wall 41*a*, defined in which is a through opening 41*b*, here circular, which forms part of the aforesaid passage of the casing 21 and inserted in which is part of the tap 10. In the example, the through opening 41*b* has a diameter substantially corresponding to that of the opening 42 of the container 40 and/or substantially corresponding to the diameter of the portion of tap 10 on which it is mounted. The bottom wall 41*a* of the lid 41 also has holes 41*c* for the passage of the screws used for fixing the lid and the container together and/or with respect to the bracket 23, the screws also passing between the spacer bushings 25*f* previously mentioned. In embodiments not represented, the lid 41 and the container 40 are associated to one another and/or fixed via means different from the ones illustrated, such as means for mutual engagement of the lid and/or of the container, preferably of a snap-in type, or else fixed by gluing or welding, in particular, welding of a laser or vibration type, or by hot re-melting of a plastic material of at least one between the lid and the container. Coupling or fixing between the lid 41 and the container 40 is preferably of the sealed type, possibly with the aid of sealing elements set in between.

Projecting from the same face of the lid 41, preferably along the corresponding perimeter, are reliefs 41*e*, for centring the lid itself on the container 40, as well as a side wall 41*f*, designed to close the opening 40*c* of the container 40

(FIG. 9). Projecting outwards from the aforesaid wall 41*f* is an appendage 41*g*, set in a position corresponding to that of the appendage 40*d* of the container 40. In the assembled condition of the device 20, the appendages 40*d* and 41*g* define at least part of an electrical-connector body, which houses the portion 25*c* of the circuit arrangement 25 on which the connector 26 is coupled. The portion 25*c* and/or the corresponding connector body 40*d*, 41*g*, on one side, and the connector 26, on the other side, may advantageously be provided with engagement means and/or biasing or encoding means in order to enable electrical coupling only with a predefined connector 26 and/or in a unique direction. The biasing or encoding means may, for example, comprise seats and/or cavities and/or holes made in the circuit board 25*a* and/or in the connector 25*c* and/or in the connector body 40*d*, 41*g*, designed to couple with respective biasing or encoding means of the connector 26, such as for example reliefs. Likewise, the engagement means may, for example, comprise at least one tooth for engagement on the connector 26 and a corresponding seat for engagement on the circuit board 25*a* and/or the connector 25*c* and/or the corresponding connector body, or vice versa.

In the embodiment illustrated, the connector appendages or portions 40*d* and 41*g* define at least one between engagement means and biasing means, for unique coupling with the predefined connector 26. More in particular, the appendage 41*g* includes a tooth (see, for example, FIG. 8) designed to couple in a corresponding seat of the body of the connector 26, whereas the appendage 40*d* has an insertion "key" comprising reliefs and cavities (partially visible in FIG. 9), for coupling with a respective substantially complementary part of the connector 26.

The connector 26 is preferably provided with elastic electrical terminals or connections, designed to contact the respective electrical terminals of the connector 25*c*, which are preferably made in the form of electrical tracks on the circuit board 25*a*, but could also be constituted by rigid metal terminals. The connection of the connector 26 to the corresponding wiring may, for example, be obtained by insulator-punchthrough connection means.

Visible in FIGS. 12 and 13 are the ring nut 22, with the corresponding position-sensor means, designated as a whole by 50, here represented isolated from the circuit board 25*a* for requirements of greater clarity of the drawings: in actual fact, however, the means 50 are mounted on the aforesaid circuit board 25*a* and belong to the circuit arrangement 25.

In the example of embodiment provided, the ring nut 22 has an axial cavity, in which there may be received a corresponding part of the gas tap, preferably comprising at least part of the rod 11. The ring nut 22 has a gripping portion 22*a*, which is preferably provided on the surface with knurling or the like. The outer profile of the gripping portion 22*a* is preferably substantially frustoconical, with major diameter on its face opposite to the wall 3*a* of the appliance. Rising from the lower face of the gripping portion 22*a* is a cylindrical hollow portion 22*b*. In the proximity of its distal end, the cylindrical portion has an internal step 22*c* that defines a contrast surface for the ring nut, in particular for resting on the end of the cylindrical portion 42*c* of the container 40 (see, for example, FIG. 9). In practice, then, in the assembled condition, the ring nut is fitted on the cylindrical portion 42*c* through the opening 41*b* of the lid, as will emerge clearly hereinafter.

The sensor means 50 may, for example, be constituted by a resistive potentiometer or by an encoder and, in general terms, by any sensor designed to detect a rotation and/or angular position of the ring nut 22. In the example represented, provided for this purpose is a resistive potentiometer, of a conception in itself known, the movable part of which can turn about an axis that is different from the axis A about which the ring nut 22 turns, in particular substantially parallel thereto. To the movable or rotary part of the potentiometer or trimmer, within the stationary component designated by 50*a*, there is associated, preferably fitted, an angularly movable element or wheel designated by 50*b*, designed to co-operate with the ring nut 22 for transmitting a movement. In the assembled condition, the stationary part 50*a* of the potentiometer is fixed to the circuit board 25*a* and electrically connected to its conductive tracks.

In the assembled condition, the peripheral edge of the wheel 50*b* rests with slight pressure on the outer surface of the cylindrical portion 22*b* of the ring nut 22, as exemplified in FIG. 13, so that a rotation of the ring nut induces rotation of the wheel 50*b*. For this purpose, preferably the wheel 50*b* is at least in part formed or coated with an elastic material, for example an elastomeric material, designed to guarantee a coefficient of friction sufficient to cause rotation of the ring nut 22 to bring about a corresponding angular movement of the wheel 50*b*. Of course, also other modes of coupling in rotation between the ring nut and the potentiometer are possible, for example via gear coupling or by providing a suitable transmission system between the ring nut and the movable part of the sensor means.

Preferably provided between the knob 12 and the rod 11 of the tap are mechanical means for transmission of motion. In one embodiment, as illustrated in FIGS. 14 and 15, a motion-transmission member is provided, designated as a whole by 51, designed for coupling with the rod 11 of the tap 10. The motion-transmission member 51 has a body 52 of a generally cylindrical shape, with an axial seat 52*a* for receiving and engaging the rod 11 of the tap 10, with a complementary coupling or in any case a coupling such that a rotation imparted on the member 51 will cause a rotation of the rod 11 (for example, the rod 11 and the seat 52*a* may have an at least partially semi-cylindrical shape). Defined on the peripheral surface of the body 52 is at least one coupling appendage 52*b* with curved profile, defining at least one engagement seat 52*c*, into which there can be inserted, preferably with axial movement, a corresponding part of the knob 12, such as a part having a shape complementary to said at least one appendage and/or seat.

In the example represented in FIGS. 16 and 17, the body of the knob 12 is generally cylindrical and hollow, having an axial cavity 12*a* of dimensions designed to receive the motion-transmission member 51 with the corresponding peripheral appendage 52*b*, as well as the upright part 43 and the supporting wall 44 of the container 40. The knob 12 has a upper wall 12*b*, provided with a central through opening, mounted in which is a protection lid 12*c*, which is substantially annular and preferably has a transparent window, appearing only in FIG. 7. The knob 12 has, in particular on the inner surface of the wall defining the cavity 12*a*, an engagement projection 12*d*, designed to couple with the aforesaid seat 52*c* defined by the appendage of the member 51, substantially with a shape fit or a complementary coupling. The seat 52*c* and the projection 12*d* are shaped in such a way that a rotation and an axial thrust imparted on the knob 12 will cause a corresponding rotation and a corresponding axial displacement, respectively, of the member 51, and hence of the rod 11 of the tap 10, in particular, without interfering with the upright part 43 and the supporting wall 44 of the container 40. The seat 52*c* and the projection 12*d* are moreover shaped for enabling, if need be, separation of the knob 12 from the member 51 by exerting a tensile force on the knob.

Figure 18:
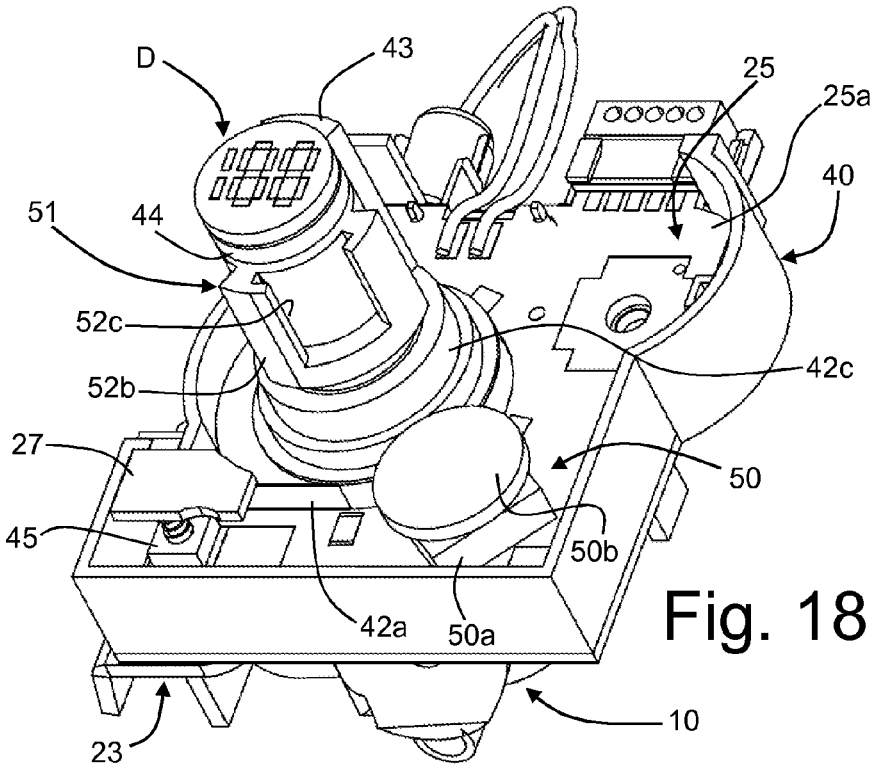
FIGS. 18-22 are partial perspective views of the device of FIGS. 6 and 7, in different steps of assembly.
Figure 19:
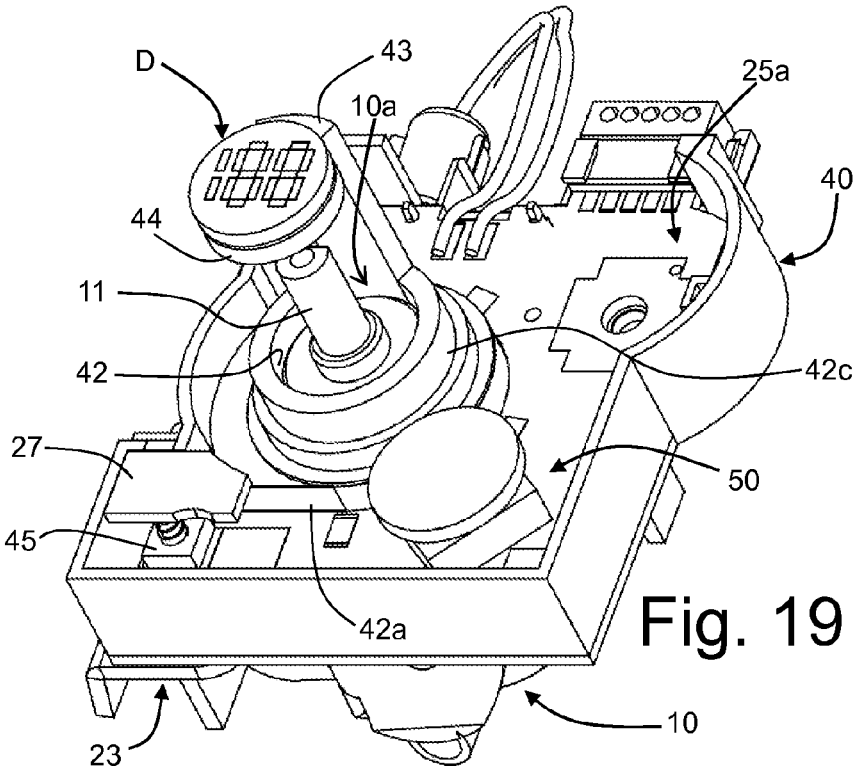

FIG. 18 represents a condition of partial assembly of the timer device, visible in which is the container 40 within which the circuit arrangement 25 bearing the sensor means represented by the potentiometer 50. In this figure, in the opening 42 of the container 40 (FIGS. 8 and 9) there is already fitted the head portion 10*a* of the tap 10, as is shown merely by way of illustration in FIG. 19. Moreover, the display D is already mounted on the supporting wall 44 that is located at the end of the upright part 43, for example fitted or glued thereon. In the example, the display has a generally disk-shaped supporting structure, of dimensions not greater than those of the wall 44. The electrical connection between the display D and the circuit arrangement may be obtained in any known way, for example via electrical conductors (in this case, in the parts 43-44 there may also be defined passages and/or grooves for these conductors) and/or by providing electrically conductive tracks directly on the plastic parts 43-44, connected to corresponding tracks of the circuit board 25*a*, or else by moulding electrical metal terminals (such as profiles sheared from a metal strap) to the plastic body of the container 40. Also possible is a wireless connection of the display D to the arrangement 25, for example with a suitable coupling of an inductive type, such as a circuit arrangement with an inductance or a receiving antenna associated to the display D and an inductance or a transmitting antenna associated to the circuit 25.

Figure 20:
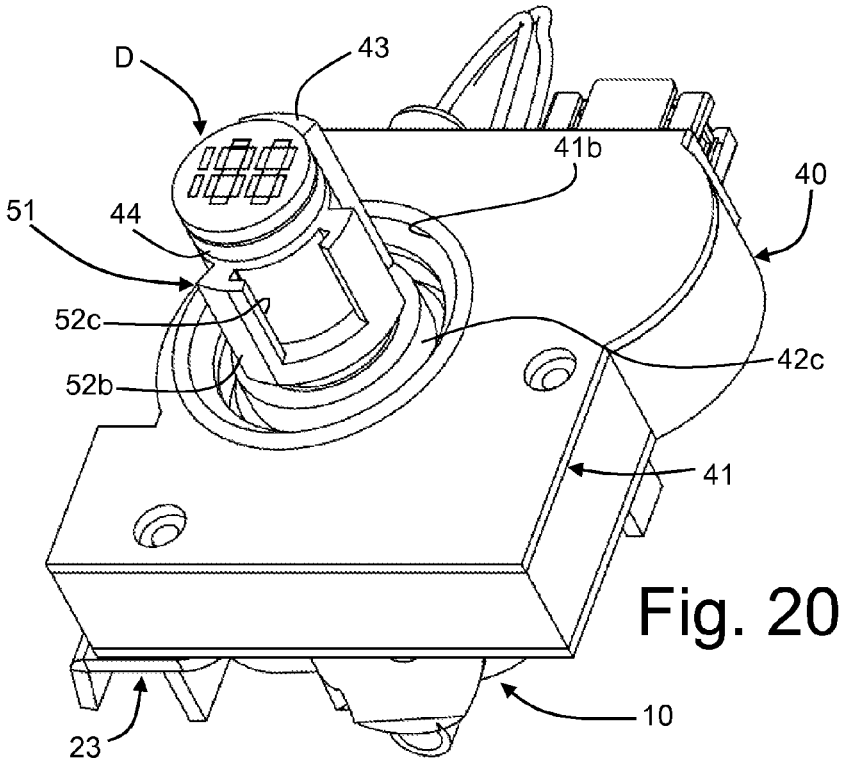

In the course of insertion of the portion 10*a* of the tap 10 in the opening 42 there is likewise obtained coupling between the motion-transmission member 51 and the rod 11. The coupling between the member 51 and the rod is unique, i.e., it is in a predetermined angular position, given the conformation of the seat 52*a* of the member itself and of the rod 11. Applied to the container 40 is the lid 41, as may be seen in FIG. 20, fitted into the opening 41*b* of which is the cylindrical part 22*b* (FIG. 13) of the ring nut 22, as may be seen in FIG. 21. The distal end of the portion 2*b* of the ring nut bears—thanks to the step 22*c* (see again FIG. 13)—upon the upper end of the cylindrical portion. 42*c*. This step is carried out taking care that the peripheral edge of the wheel 50*b* of the potentiometer engages with the outer surface of the cylindrical portion 22*b* of the ring nut 22.

Next, on the ensemble that includes the display D, with the corresponding supporting walls 43-44, and the motion-transmission member 51, the knob 12 is axially fitted, due care being taken that its relief 12*d* fits into the corresponding seat 52*c* defined by the appendage 52*b* of the member 51. As already mentioned, the relief 12*d* and the seat 52*c* are shaped for constraining the knob 12 to the member 51 so as to enable a rotation and pressure applied on the knob to be transmitted to the rod 11 of the tap. Following upon coupling, when the relief 12*d* bears upon the bottom of the seat 52*c*, the through opening 12*a* of the front wall of the knob 12 is located at a short distance from the display D, which is hence directly visible from outside, as emerges, for example, in FIG. 22. Preferably, the knob 12 is equipped, at its through opening 12*a*, with a protection element, such as a transparent plug or lid. During the operations of pressure on and axial movement of the knob, the display D remains in any case within the overall dimensions of the knob 12, i.e., in a protected condition.

Figure 21:
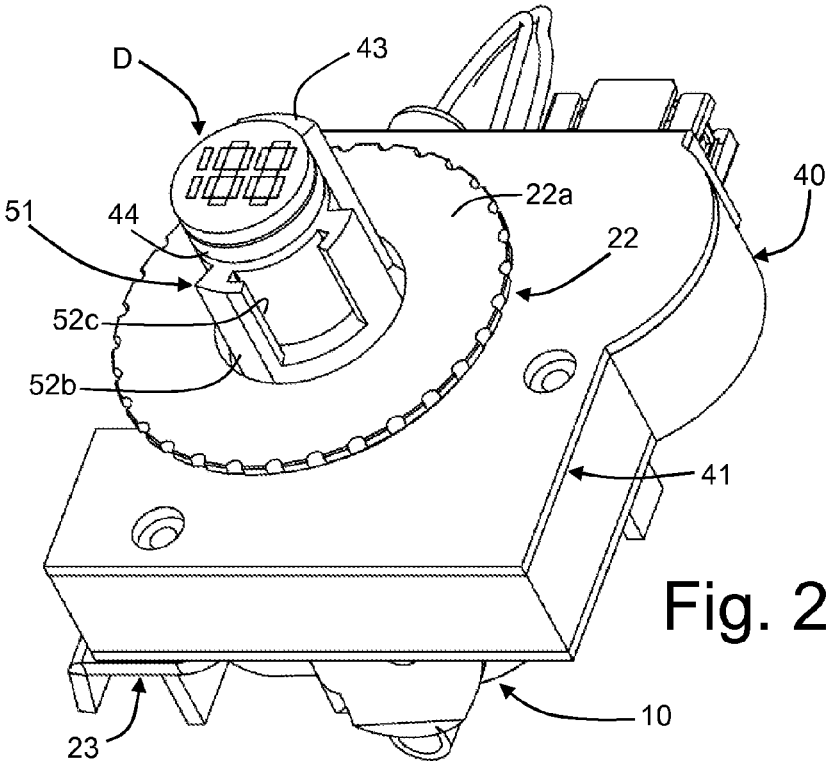
Figure 22:
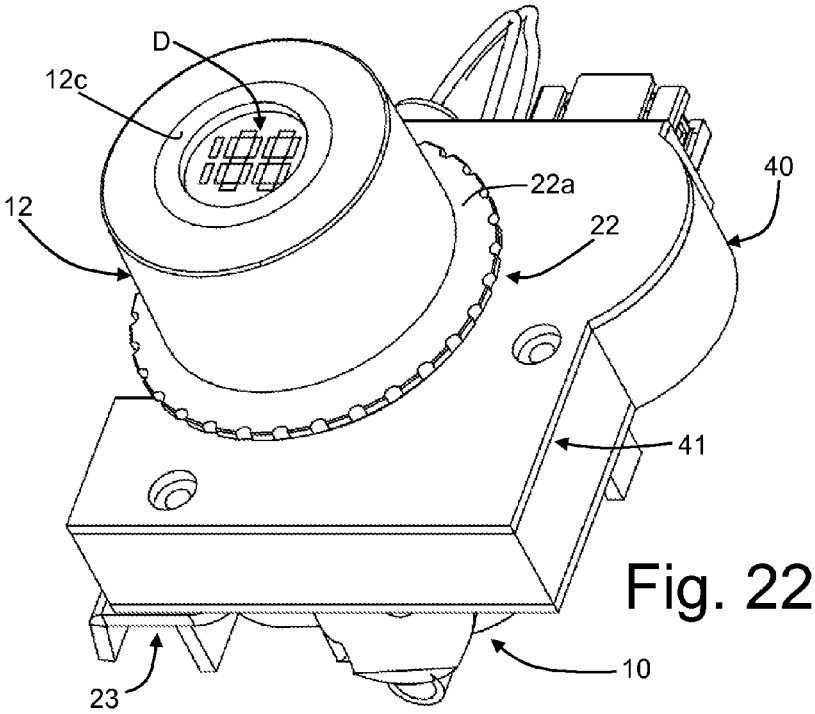

It should be noted that FIGS. 21 and 22 are provided merely by way of example given that, in actual fact, in the course of installation, the lid 41 of the casing of the device faces the wall 3*a* of the cooking appliance, with the aforesaid wall—provided with the corresponding through opening—that is set between the ensemble constituted by knob 12 and ring nut 22 and the lid 41, as shown, for example, in FIG. 6.

It will be appreciated that, with the arrangement described, the display D always remains in a fixed position, irrespective of the rotation imparted on the knob 12 and/or on the ring nut 22 by a user, with the advantage of increased intelligibility of the information represented by the display itself. It will likewise be appreciated that, in the assembled condition of the device, the upright part 43 and the appendage 52*b* of the motion-transmission member 51 form together end-of-travel means for the angular movement allowed for the knob 12 in the two directions. Obviously, mechanical end-of-travel means may also be provided for the ring nut 22, in particular in order to define a zero position for the ring nut itself.

As has been said, the lid 12*c* of the knob 12 is generally annular, i.e., it defines a respective axial passage that is closed at the top by the transparent window represented only in FIG. 7. This passage has dimensions—in particular in terms of diameter and height in an axial direction underneath the transparent window—such as to enable sliding thereof with respect to the stationary display D, when the knob 12 is pressed, thus also functioning as guide. The display D is thus in any case in a protected position. In one embodiment, the structure of the display D includes a protective casing of its own, which is transparent at least in its upper part, for protecting the corresponding display components when the knob 12 is occasionally removed from the tap, for example for carrying out cleaning operations. Of course, the functions of the lid 12*c* may be integrated directly in the body of the knob 12, which in this case will have applied thereon just the transparent window or will possibly integrate said window directly (the body of the knob 12 may be moulded using different materials, one of which transparent to obtain the aforesaid window).

As already clarified, the device 20 is prearranged for performing at least a function of timing of the supply of gas to the burner controlled by the tap 10, and includes for this purpose at least a timer circuit and a means for manual setting of the supply interval, here represented by the ring nut 22, which can be operated from the outside of the structure of the appliance and is substantially coaxial to the knob 12 of the tap 10. In one embodiment, such as the one described previously, the knob 12 and the ring nut 22 can be turned by a user, preferably independently of one another, about the axis designated by A, in order to enable, on the one hand, adjustment of the flow of gas admitted to the burner and, on the other hand, setting of the time of supply of the burner. The knob 12 is also axially movable, unlike the ring nut 22 (on the other hand, as has been mentioned, in possible variant embodiments also the ring nut 22 could translate axially).

Figure 23:
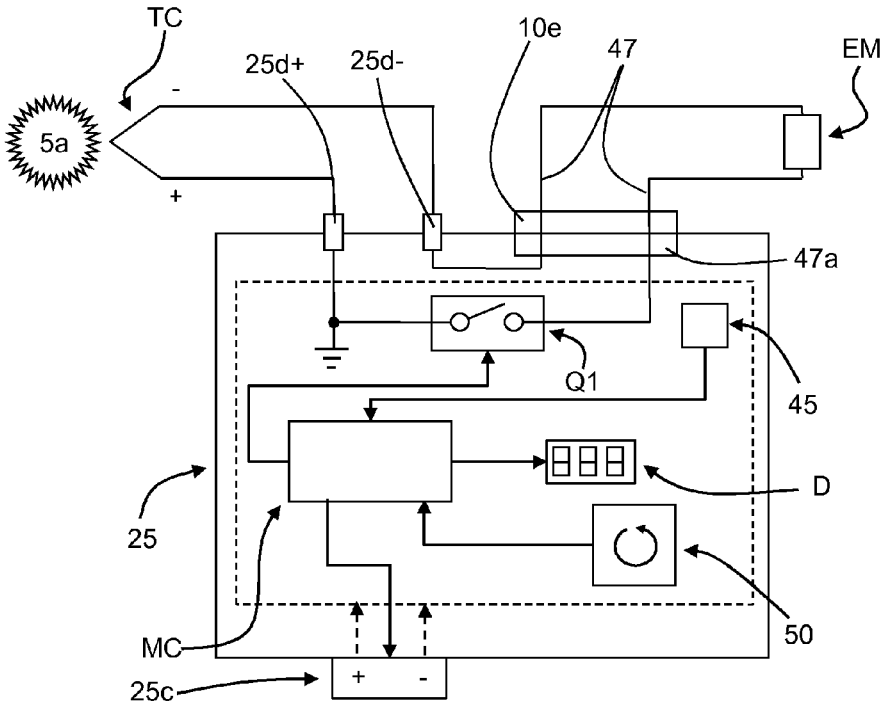
FIG. 23 is a simplified block diagram of a circuit arrangement of a device according to the invention, connected between a thermocouple and the electromagnet of a gas tap.

As represented schematically in FIG. 23, the timer circuit MC is implemented in the circuit arrangement 25, which likewise includes first switching means Q1,which can be controlled for causing interruption of electrical supply to the electromagnet EM of the safety valve of the tap 10, upon expiry of the time interval set via the ring nut 22, and thus cause passage of the aforesaid valve into the respective closed condition. For this purpose, the first switching means Q1are preferably connected in series between the thermocouple TC provided for the tap 10 and the electromagnet EM of the corresponding safety valve.

The timer circuit MC can be obtained in any known way, for example including, in the circuit arrangement 25, a commercially available microcontroller provided with clock or timer function, which can preferably be supplied with a low d.c. voltage (for example 3-12 Vdc) via a supply stage or stabilized power supply. The aforesaid microcontroller MC, in which the program or software for control of the device can be implemented, is connected in signal communication to the position-sensor means, here represented by the potentiometer 50, from which the information regarding the time interval set is obtained.

The first switching means Q1preferably include at least one switch that can be controlled for opening or varying the electrical circuit of the thermocouple TC, when the time interval in which the burner 5*a* is to remain lit set via the ring nut 22 has elapsed. The controllable switch may be of an electro-mechanical type, for example a relay, or else of an electronic type, for example a MOSFET, and is preferably, but not necessarily, of a normally open type, switchable via a pulse or signal governed by the timer circuit MC. In a preferred embodiment, the switch Q1is an electronic switch, in particular a MOSFET with extremely low channel resistance, set in series to the thermocouple TC-electromagnet EM circuit. A switch of this sort guarantees, in the case of conduction, an extremely low resistance of the circuit and enables requirements of miniaturization to be met.

According to possible variants, the switching means may include a device or circuit configured for varying the electrical circuit of the thermocouple, for example a load (such as a resistance), which, when rendered active, reduces the current to the electromagnet EM.

As has been said, in a preferred, albeit non-exclusive, embodiment of the invention, the device 20 is also prearranged for the purposes of control of a lighter system. The circuit part regarding the lighter system can be obtained in any known way, and is not necessarily implemented in the circuit arrangement 25.

The potentiometer 50, or other component that stands in for it, basically has the function of detecting the position, among a plurality of possible positions, assumed by the manual-control means represented by the ring nut 22, this position representing the duration of the time interval set. As has been said, in a preferred embodiment, the stationary component 51*a* is constituted by a rotary potentiometer, in particular of a resistive type, preferably of the type designed to be mounted and/or welded directly on a circuit board 25*a*, such as a trimmer, but its functions may be evidently obtained via other electrical and/or electronic components, such as for example optical or magnetic encoders and sensors. The person skilled in the branch will hence appreciate that the actuation element of the sensor means do not necessarily have to be represented by a wheel with rotary shaft, such as the wheel 51*b*, it being possible to obtain it with some other type of movable element.

The control element, here represented by the switch 45, of the circuit arrangement 25 basically has the function of generating the command signal that the microcontroller circuit MC handles for determining or controlling initial closing of the switch Q1and start-up or otherwise of a time count. The signal generated by the switch 45 can also be used by the arrangement 25, and, in particular, by its microcontroller MC, for generating the switching pulse of the control means associated to the circuit of the lighter system. The switch 45 and the aforesaid control means of the lighter system can be electrically separated or insulated from one another.

In the embodiment illustrated, the display D is used at least for displaying, to a user of the device, the time—for example, in minutes and/or minutes and seconds—that can be set with the ring nut 22. In other words, the control logic of the microcontroller MC is such that, following upon activation in programming of the device 20, to rotation of the ring nut 22 there corresponds the indication on the display D of a time corresponding to the extent of the angular movement imparted on the ring nut itself. In this way, the user is informed in a clear and precise way. In a preferred embodiment, moreover, the control logic is prearranged in such a way that, when the timing function has been activated by a user, the display D will represent the residual time, i.e., the time remaining until expiry of the period of time set by the user.

For example, on the display D, the residual cooking time may be updated constantly, as countdown. Also the progressive time may be updated constantly, as an incremental count.

In a preferred embodiment, the control logic of the device 20 is configured in such a way that display of the residual time will be rendered active after lighting of the burner and programming of a time by the user.

In an advantageous embodiment, the control logic is configured for activating display of the progressive cooking time if the user lights the burner but does not proceed to programming the device 20 with which the corresponding tap is equipped (for such a case, incremental counting of the time can start from detection of the flame, for example obtained via the electrical signal generated by the thermocouple). Advantageously, the control logic can also be configured in order to enable reset of display of the progressive time, starting off a new progressive count (for example, by applying a brief pressure on the knob 12). In an embodiment of this sort, and irrespective of whether the device 20 has been programmed or not, the active condition of the display means D also represents the condition of ignition of the burner so that the user is informed in a clear way on the effective presence of the flame.

On the other hand, in other possible embodiments, it is possible to provide a display on demand of the residual time and/or of the progressive time: in this case, for example, after start-up of a cooking process the display D is sent, after a predetermined time, into a quiescent state, i.e., a state where it is substantially turned off and, following upon a brief pressure applied on the knob 12 (which can be detected via the switch 45) the residual time for which the flame is lit and/or the time that has elapsed from ignition of the flame is displayed (according to the cases). Preferably, in any case, it is possible for the display of the residual time in countdown mode to be rendered active in an autonomous way by the control logic, upon reaching of a predetermined time of forewarning prior to expiry of the time for which the flame is lit programmed via the ring nut (for example, three minutes before expiry programmed via the ring nut, the countdown starts to be displayed on the display D). The forewarning time can also be notified in other ways, for example via a suitable flashing indication on the display and/or providing acoustic-warning means, such as for example a buzzer or a similar tone generator.

Obviously, the cases of information that can be represented to the user via the display D may be various, such as for example a confirmation that the device 20 has entered the programming mode correctly and/or a confirmation of the time set by the user.

Assembly of the device 20 is very simple. Once the casing 21 has been assembled on the bracket 23, the latter is fixed to the body of the corresponding tap 10, possibly already mounted on the part 2 of the structure of the appliance 1. The head portion 10*a* of the tap is thus inserted in the through opening of the casing 21, with the actuation element 10*f* of the tap that is located in a position corresponding to the recess 42*b* of the container 40 (see, for reference, FIGS. 7-9), coupled to the motion-transmission element 27 of the device 20.

The connector 47*a* of the device 20 is connected to the corresponding attachment 10*e* of the tap, whereas the conductors of the thermocouple TC are connected to the contacts 25*d* of the device 20.

After assembly of the part 3 of the structure of the appliance 1, the motion-transmission member 51 and the ring nut 22 are fitted in position, as explained previously.

Then coupled to the member 51 is the knob 12. The coupling is configured for enabling removal of the knob 12 and of the ring nut 22 itself by the user, for example for cleaning purposes.

General operation of the device may be at least in part similar to the one described in the document No. WO 2010134040, to which the reader is referred.

In one embodiment, in order to program a desired time interval during which the burner is to remain lit, the user exerts a short pressure on the knob 12. The pressure applied on the knob 12 causes axial displacement of the motion-transmission member 51 and of the rod 11, and hence of the actuation element 10*f* and of the motion-transmission element 27, with consequent switching of the control element represented by the switch 45: the device 20 in this way enters the programming step. In a preferred embodiment entry into programming mode is signalled/confirmed via a flashing of the display D, which in this step has already been switched on. Switching-on of the display D may be obtained, for example, following upon a previous switching of the switch 45, which has taken place upon lighting of the burner. In possible variant embodiments, on the other hand, switching-on of the display and programming of the time could be carried out before lighting the burner, with the subsequent counting of the time made starting from ignition of the flame, detected by the device 20 (for example, through the signal generated by the thermocouple).

Within a subsequent given time interval (for example, one minute) the user has to turn the ring nut 22 for setting the desired time, for example ranging between 1 and 120 minutes, which is highlighted on the display D. The control logic may envisage that a new brief pressure applied on the knob 12, and consequent switching of the switch 45, constitutes a confirmation of the desired programming time, possibly highlighted on the display (for example, via a short flashing).

In the preferred embodiment, programming is carried out after lighting the burner. To obtain lighting of the burner, the user has to turn the knob 12 and press it, for a time sufficient to bring about initial opening of the safety valve and activation of the possible gas lighter, with consequent switching of the switch 45. The corresponding signal generated by the switch 45 is used by the control logic of the device 20 for controlling closing of the switching means Q1 provided on the circuit arrangement 25, connected in series between the thermocouple TC and the electromagnet EM of the safety valve, and for possibly starting counting of the time and generating the command signal of the switch associated to the lighter system, when this function is envisaged. Once the burner 5*a* has been lit, the heat generated by the flame causes the thermocouple TC to generate the current necessary to keep the safety valve of the tap 10 open. The presence of the signal from the thermocouple evidently indicates that the flame is lit.

As has been said, during cooking, the display may be kept active for displaying—in the form of countdown—the remaining time, in the case of programming of the device, whereas, in the absence of programming, upon lighting of the burner, the display is activated and starts to show the cooking time in progress. In other words, even in the absence of programming of the device, the display is used for providing information on the total time elapsed starting from lighting of the burner, with the possibility of resetting the count and restart it.

At the end of the time interval set via the ring nut 22 (after prior possible forewarning), the control logic generates a new signal of switching of the switching means Q1,which in this way open the circuit of the electromagnet EM, with consequent closing of the safety valve of the tap 1. The burner is thus turned off once the pre-set time has elapsed.

In a possible embodiment, the device 20 preferably has a predefined position of non-intervention in order to enable normal use of the tap 10 and of the corresponding burner without activation of the timing function, in the case where there is not envisaged brief pressure on the knob to enter the programming step or the step of confirmation of programming. This position may conveniently be represented by an angular position of "zero" of the ring nut 22. When the ring nut 22 is in this position, detected via the sensor means 50, the functions of the circuit that are associated to the time count will not be active. In another embodiment, for example, as the one described hereinafter, a position of mechanical zero for rendering the device inactive is not envisaged: in this case, via movement of the ring nut 22, the time indication that appears on the display is modified, with the possibility of bringing it to zero. Pressure on the knob 12 will cause, in the ways already described above, generation of the signal that determines closing of the switching means in series between the thermocouple and the electromagnet in order to guarantee the electrical continuity necessary for opening the safety valve, and/or will cause generation of a signal for control of the lighter module.

Figure 24:
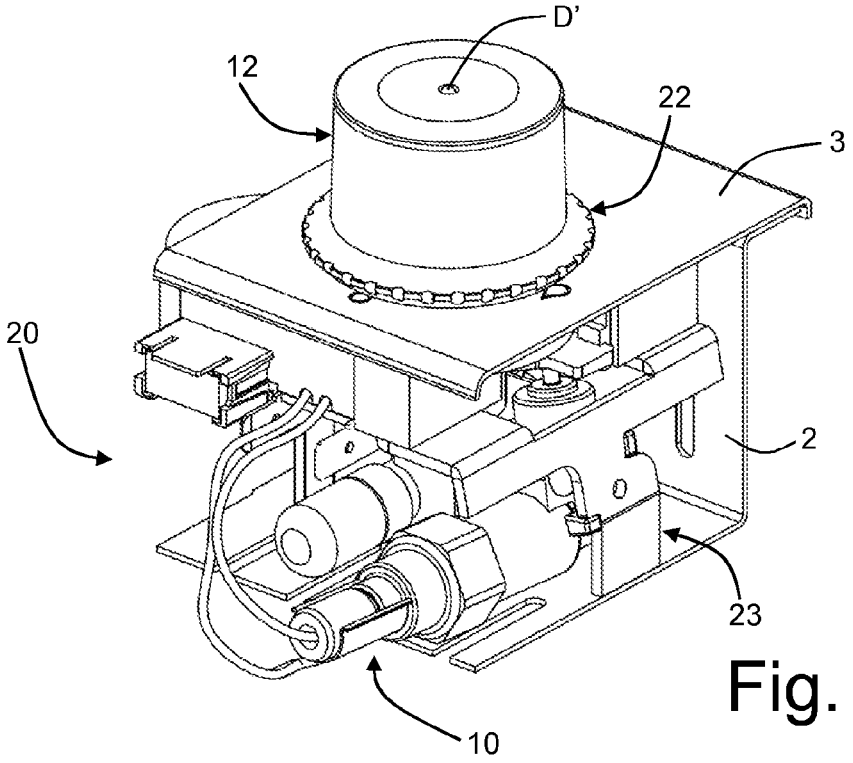
FIG. 24 is a view similar to that of FIG. 6 but regarding a different embodiment of a device according to the invention.
Figure 25:
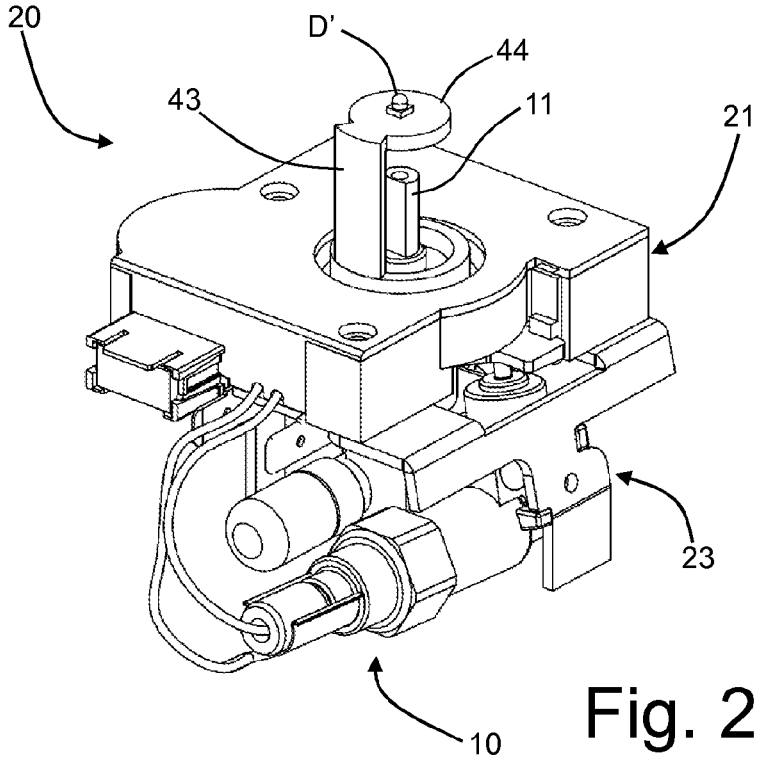
FIG. 25 is a view similar to that of FIG. 24, with some components removed.

FIGS. 24 and 25 exemplify a variant embodiment where the device 20 is equipped with visual-warning means different from a display of (alphabetic and/or numeric and/or abstract) characters such as the one previously designated by D. In this case, the warning means D' consists of a single source of light, for example a LED, which is mounted on the supporting wall 44.

As may be appreciated, the arrangement is similar to the one described previously, apart from slight modifications in the shape of the knob 12, and especially in relation to the dimension of the through opening of its front wall. Also in this case, the LED D' can be supplied via conductors, conductive tracks, or in wireless mode (for example, with an inductive coupling). It goes without saying that, instead of just one LED, there may be provided a plurality of LEDs. The use of one or more LEDs according to the variant proposed does not necessarily enable display of times, but may be useful for supplying at least some warnings in this regard, for example, the operativeness of the device 20, its entry into the programming phase, confirmation of the time set, forewarning of expiry of the time set, condition of ignition of the flame and/or its extinction, etc. Instead of one or more LEDs, on the wall 44 there may be envisaged one or more lamps, or the terminal part of one or more optical guides.

FIGS. 26-49 are schematic illustrations of a timer device according to a further embodiment of the invention. In these figures the same reference numbers are used to indicate elements that are technically equivalent to the ones already described above. As in the case of the first embodiment, also the device of FIGS. 26-49 is provided with visual-warning means, preferably comprising a display designed for representing alphabetic and/or numeric and/or abstract characters. Preferably, also in this case, the display is mounted in a stationary position: in particular, the display D is stationary with respect to the structure 2-3 of the appliance 1, even when the knob 12 and the ring nut 22 are moved.

Figure 26:
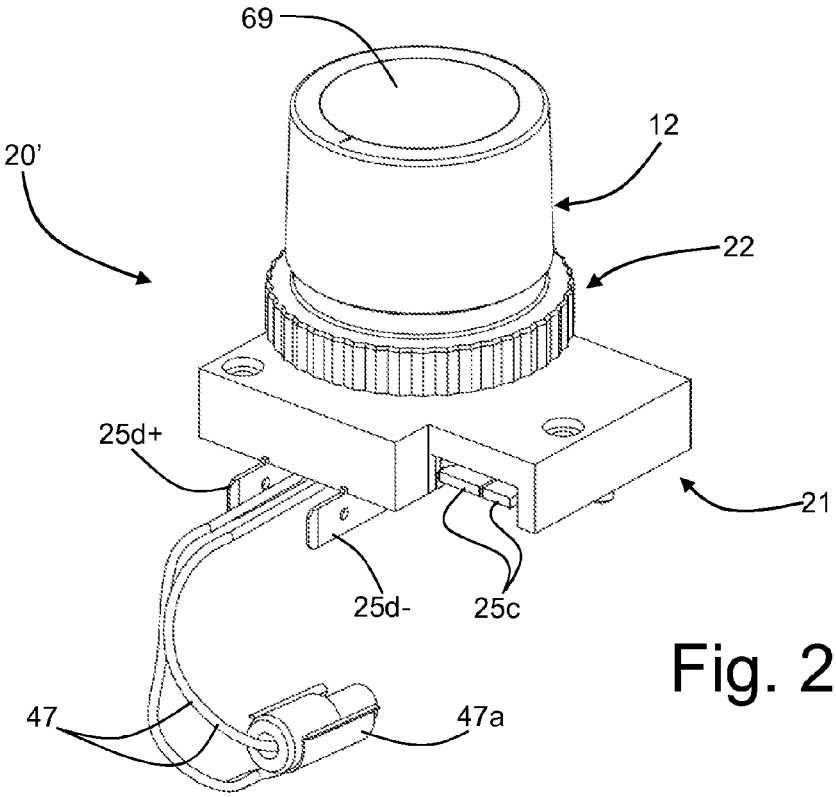
FIGS. 26 and 27 are perspective views, from different angles, of a timer device in a further embodiment of the invention.
Figure 27:
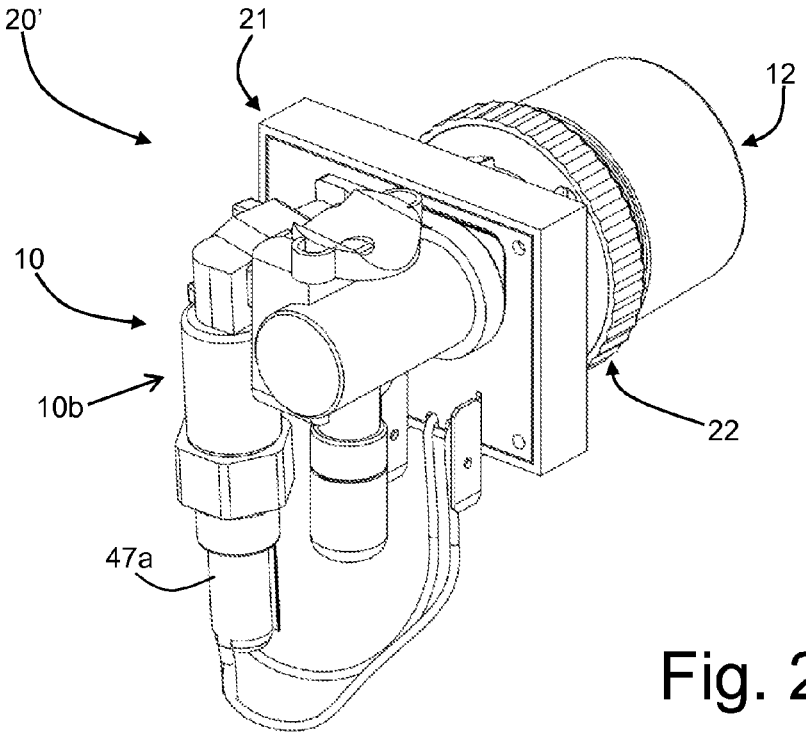

As emerges from FIGS. 26-27, the general structure of the device, designated by 20', is substantially similar to that of the previous embodiments, with the tap 10 inserted at least partially in a through opening of the casing 21. The latter casing 21 has overall dimensions generally smaller than in the case of the previous embodiments, operation of the device remaining the same.

Figure 28:
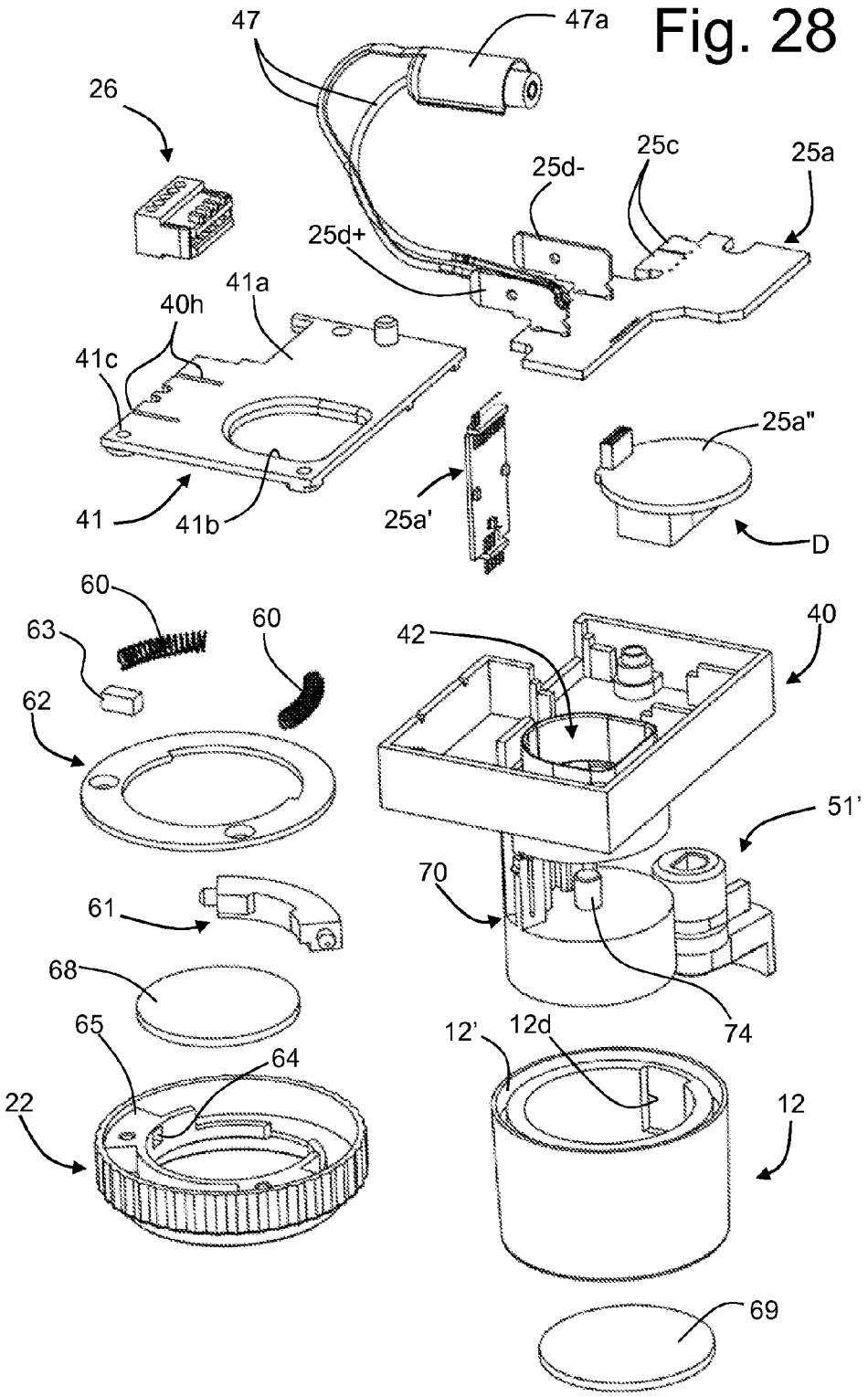
FIGS. 28 and 29 are exploded views, from different angles, of the device of FIGS. 26-27.
Figure 29:
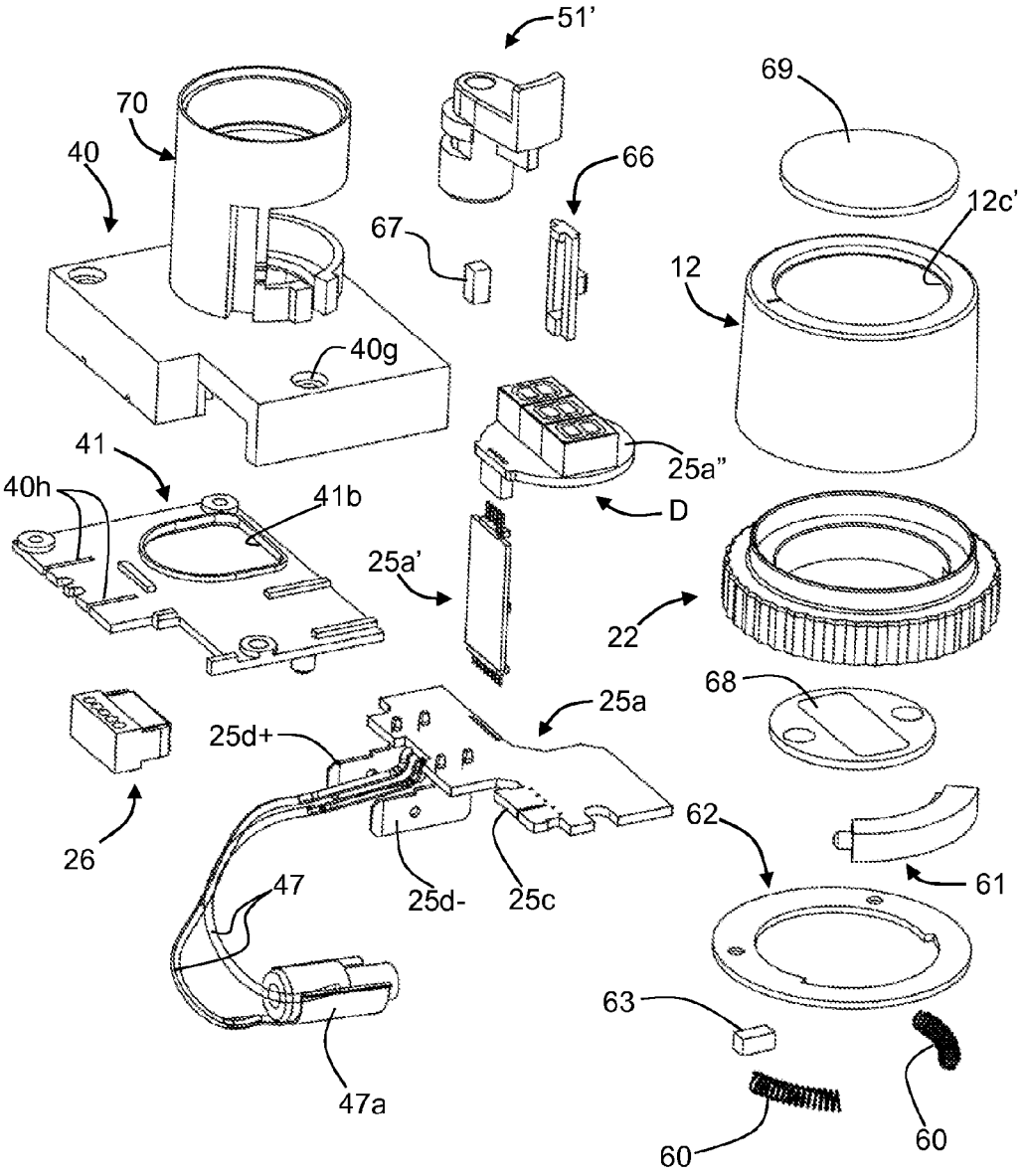

The main components of the device 20' are visible in the exploded views of FIGS. 28 and 29. In these figures, consequently, designated by 40 and 41 are the container and the lid of the casing 21. It may be noted that, in this example of embodiment, the arrangement of the two parts of the casing is reversed as compared to the previous examples, i.e., with the lid 41 that closes the container 40 on the opposite side with respect to the knob 12 and the ring nut 22. For this reason, the slits 40*h* for the passage for the blade terminals 25*d* are envisaged on the lid 41. Also the body of the ring nut 22 has a generally different conformation, its outer profile remaining, however, substantially circular. As will emerge clearly hereinafter, in this case the ring nut 22 is provided for performing limited angular movements in clockwise and counterclockwise directions, with respect to a central zero position, in order to carry out a setting of a substantially discrete type of the programming time, basically behaving as pushbuttons for increment (+) and decrement (−) of the time and/or of other programming parameters.

For the above purpose, associated to the body of the ring nut 22 is a corresponding system for fixing or restoring the position. In the example represented, this system includes a pair of springs 60 and a corresponding intermediate element of constraint or slider 61, directly housed within the body of the ring nut 22, which is provided with a corresponding lid 62. Moreover, and once again with reference to the non-limiting example illustrated, the ring nut 22 includes an excitation element for corresponding sensor means, this element being here constituted by a magnetic element 63, such as a permanent magnet, housed within a corresponding seat 64 defined in a shaped internal part 65 of the body of the ring nut 22.

The circuit arrangement of the device 20' includes, in this embodiment, the circuit board 25*a*, with corresponding electrical/electronic components associated thereto, designed for being housed in the cavity within the container 40, as well as a second circuit board 25*a*', electrically coupled to the circuit board 25*a*, and moreover electrically coupled to which is the display module D. The circuit board 25*a*' is designed to be mounted in a position generally orthogonal with respect to the circuit board 25*a*, and housed within a mounted part 70 of the container 40, as described more fully hereinafter. Once again with reference to FIGS. 28-29, designated by 51' is a motion-transmission member, designed for coupling with the rod 11 of the gas tap, on one side, and with the knob 12, on the other side, which is purposely provided with a corresponding internal coupling seat 12*d*. In FIG. 29, designated by 66 is a sliding element, defined hereinafter for simplicity as "slider", designed for being mounted within the upright part 70 of the container 40 and provided for supporting a corresponding excitation element 67, such as a permanent magnet, for corresponding sensor means. Finally, designated by 68 and 69 are two generally disk-shaped lids, made at least in part of transparent material, for protection of the display module D.

Figure 30:
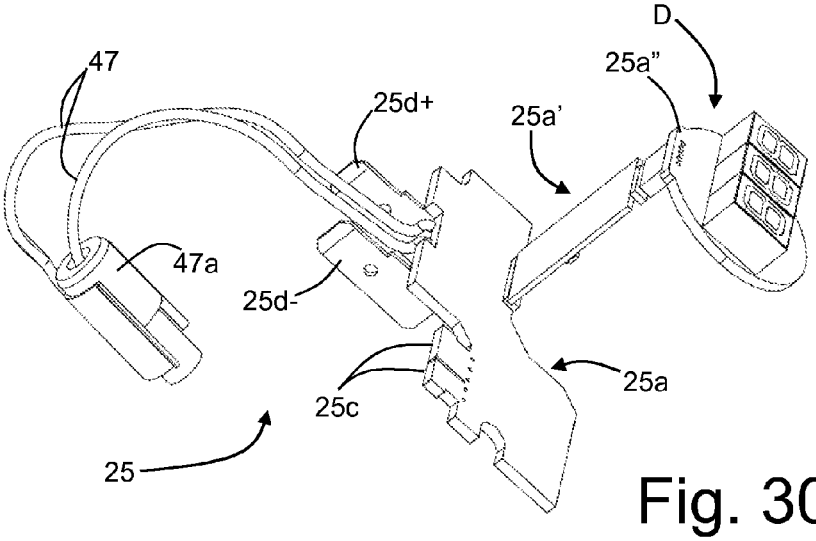
FIG. 30 is a perspective view of a circuit arrangement of the device of FIGS. 26-27.

Visible in FIG. 30 is the circuit arrangement 25 of the device 20', including the circuit boards 25*a* and 25*a*', as well as the display module D.

Associated to the circuit board 25*a* are the conductors 47 and the connector 47*a*, as well as the terminals 25*d*+ and 25*d*−. Preferably, associated to the circuit board 25*a* is a multipolar pin connector, for coupling to a complementary connector provided at one end of the circuit board 25*a*'; the aforesaid connector of the circuit board 25*a*' is preferably soldered to a connector obtained from conductive tracks of the circuit board 25*a*.

Once again preferably, associated to the other end of the circuit board 25*a*' is another similar connector, for coupling to a complementary connector of the display module D, which here includes a corresponding circuit board 25*a*" bearing display elements, for example of the LED or LCD type. The arrangement exemplified is such that the supports 25*a* and 25*a*" are generally parallel to one another and orthogonal with respect to the circuit board 25*a*', which is intermediate between them and connects them together. As will be seen, the sensor means referred to previously are preferably associated to the circuit board 25*a'*.

FIGS. 31-34 illustrate, in different views, the container 40. Also in this embodiment, the bottom wall 40*a* of the container 40 includes an at least in part tubular portion 42*a*, projecting towards the inside of the cavity of the container itself, which girds and in part provides the passage 42. On the opposite side of the wall 40*a* there rises the upright part 70 referred to previously, which is internally hollow and has an at least partially cylindrical outer shape. In particular, in the part 70 there may be identified a lower portion 71, which is preferably generally cylindrical, an upper portion 72, which is preferably generally cylindrical, and a lateral intermediate connection portion 73, with an outer profile preferably radiused like portions 71 and 72, which supports the portion 72 substantially in cantilever fashion. The lower portion 71 is axially hollow and defines, along its outer profile, a projecting contrast element 71*a*, here including two reliefs.

The upper portion 72 is generally hollow, but closed at the bottom by a bottom wall 72*a*, where the upper end of a seat or passage 73*a* is located in the intermediate portion 73. Defined between the bottom wall 72*a* and the peripheral wall of the portion 72 is a step or relief 72*b* to provide a rest for the circuit board 25*a*" of the display module D. A similar step or relief 72*c* is provided at the upper end of the peripheral wall of the portion 72, for positioning of the lid 68.

Also in this embodiment, the container 40 and the lid 41 prevalently form the first part of the stationary structure of the device, which houses at least part of the circuit arrangement 25 and is installed within the body 2, 3 of the appliance 1. The upright part 70 provides, instead, the second projecting part of the stationary structure, configured for supporting the display means D in a fixed position; also in this case, in the condition where the device 20 is installed, said second part of structure projects on the outside of the body 2, 3 of the appliance 1.

Figure 31:
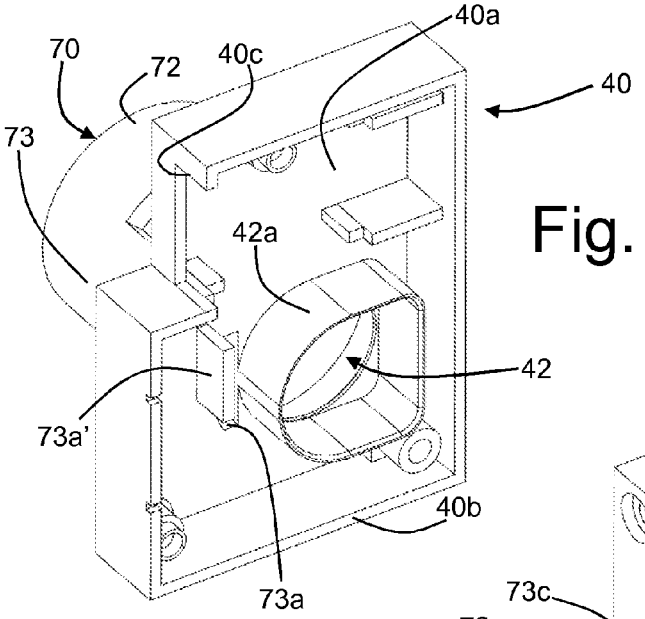
FIGS. 31-34 are perspective views, from different angles, of a component of a casing of the device of FIGS. 26-27.
Figure 32:
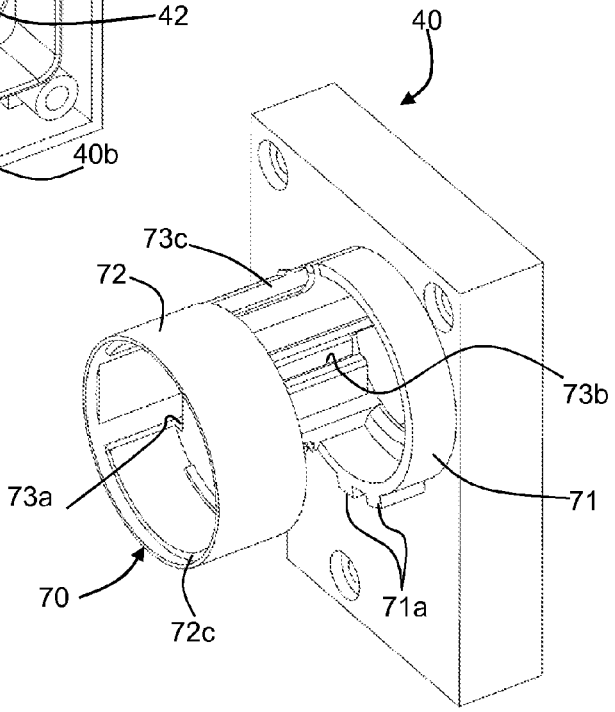
Figure 33:
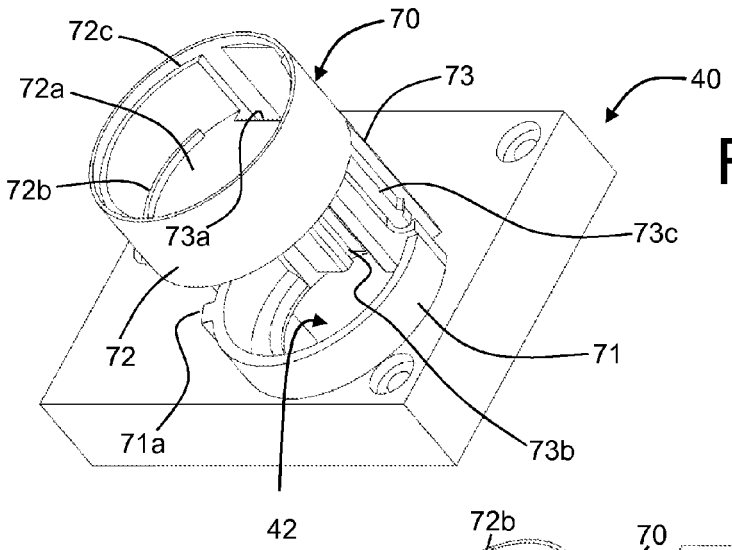
Figure 34:
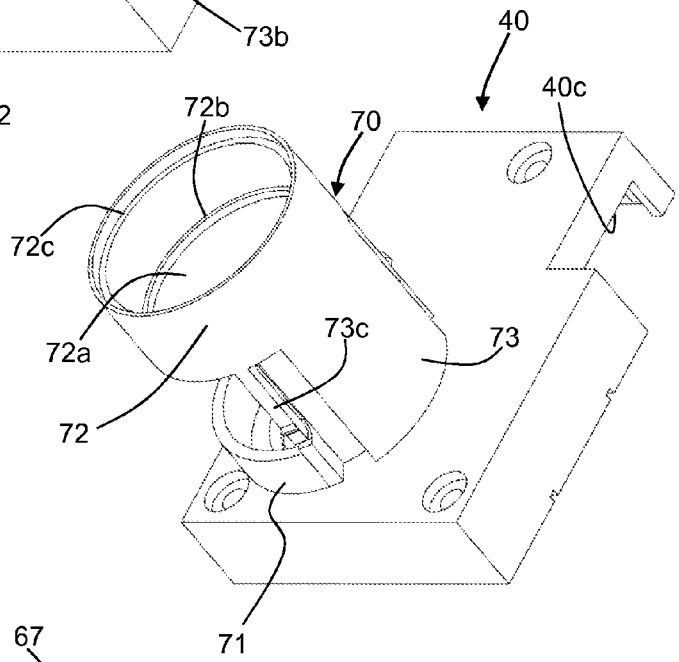
Figure 49:
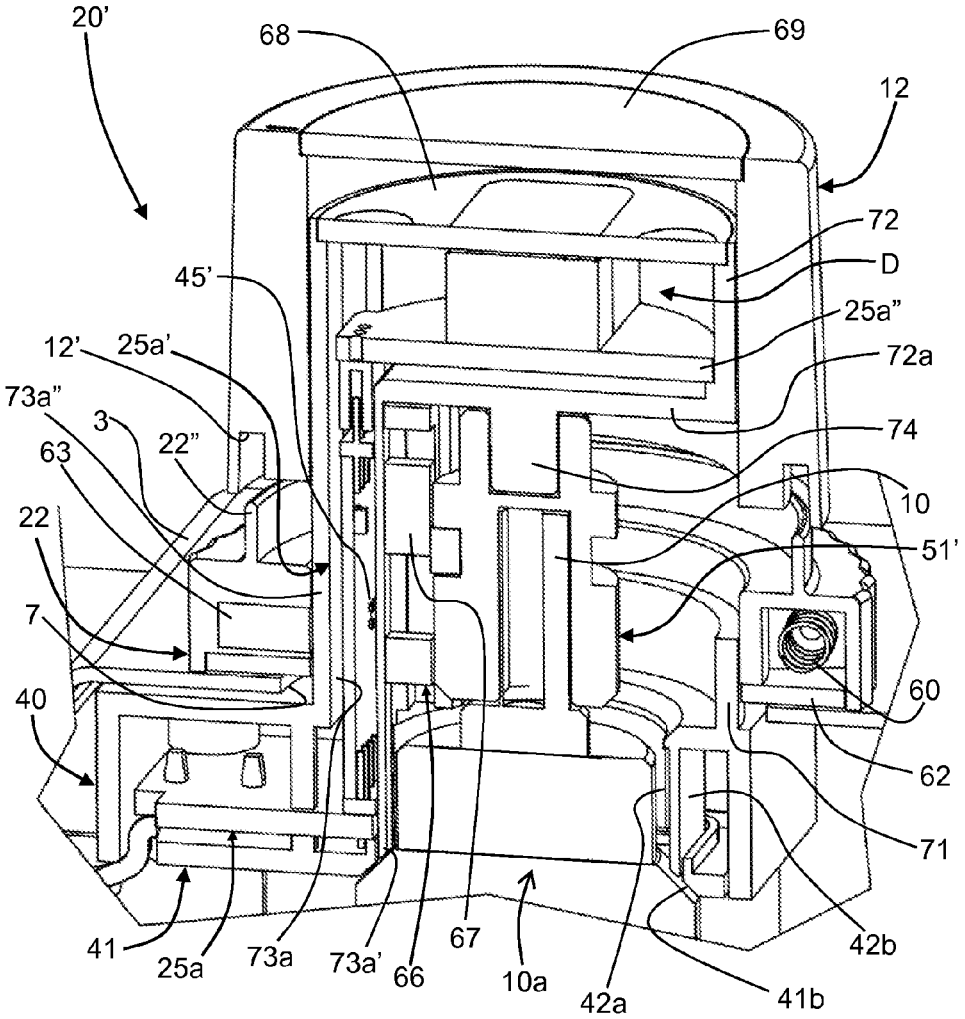
FIG. 49 is a partial schematic cross-sectional view of the device of FIGS. 26-27 according to a plane lying in which is the axis of rotation of a control means of the device and of the gas tap associated thereto.

As has been said, inside the intermediate vertical portion 73 there extends a passage 73*a*, which opens, on one side, in the region of the bottom wall 72*a* of the portion 72 and, on the other side, in the region of the bottom wall 40*a* of the container 40, as may be seen in FIG. 31 (see also FIG. 49).

The portion 73 then defines, in a position generally parallel to the passage 73*a*, a movement seat or guide 73*b* (FIGS. 32 and 33) where the slider 66 of FIG. 29 is designed to be slidably engaged.

Preferably, within the intermediate portion 73, the circuit board 25*a*' and the magnet 67 are in positions substantially isolated from one another, with a wall set in between. In the example represented, the guide 73*b* is defined in a wall—designated by 73*a*' in FIGS. 41, 46 and 49—that delimits the passage 73*a* at the front, i.e., a wall that separates or isolates from one another the circuit board 25*a*' and the magnet 67, or the corresponding slider 66.

In the example of embodiment illustrated, moreover, the intermediate portion 73 also defines an axial engagement tab 73*c*, for engagement with the ring nut 22.

Figure 35:
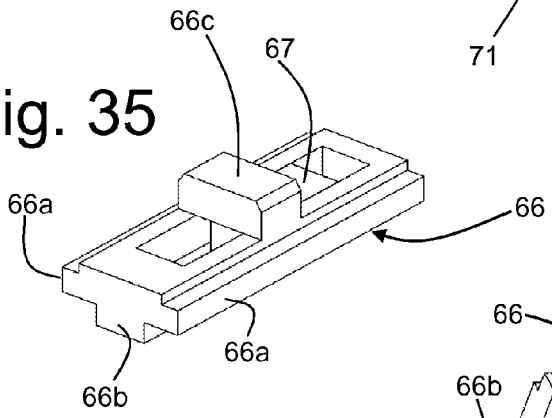
FIGS. 35 and 36 are perspective views, from different angles, of a slider member of the device of FIGS. 26-27.
Figure 36:
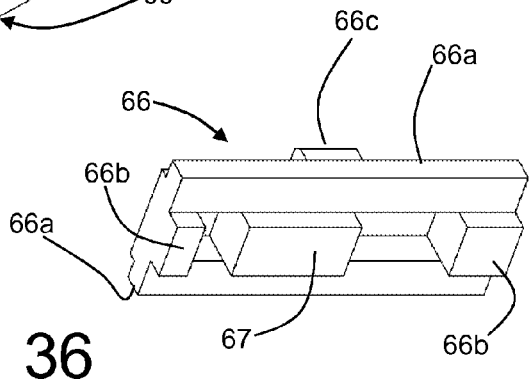

The slider 66, visible in FIGS. 35-36, has a respective body made of plastic material, constrained (for example, by slotting, gluing, or overmoulding) or associated to which is the excitation element represented by the magnet 67, the body being shaped for slidable engagement of the intermediate portion of the upright part 70 in the guide 73*b*.

Figure 41:
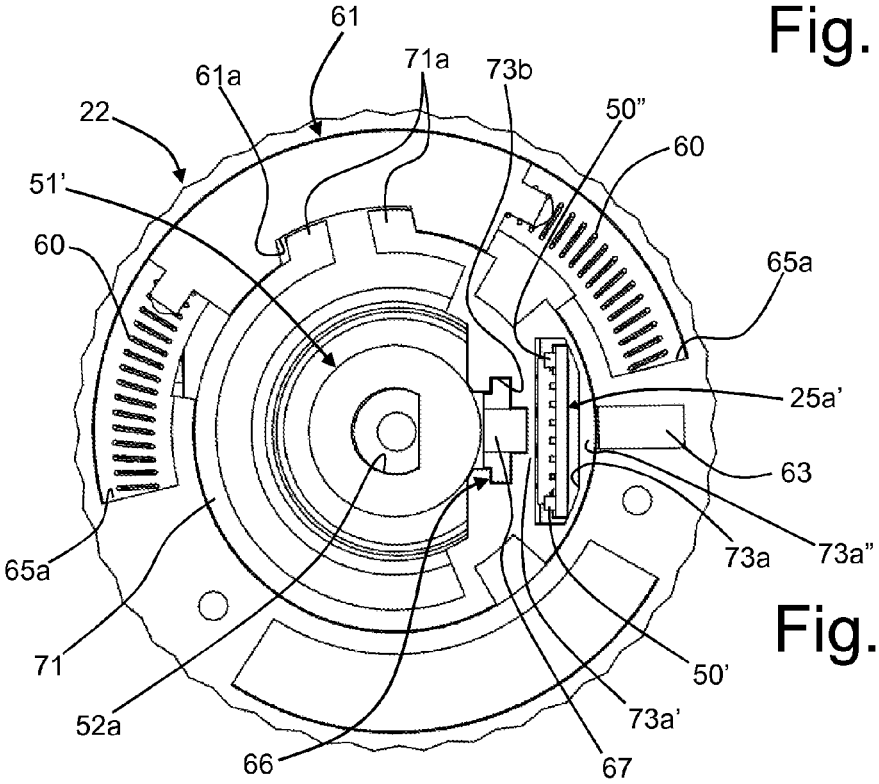
FIG. 41 is a partial and schematic cross-sectional view of the device of FIGS. 26-27 according to a plane passing through a control means of the device and orthogonal to an axis of rotation thereof.

In the case illustrated, the body of the slider 66 has two opposite longitudinal side guides or edges 66*a* and two rear guides or reliefs 66*b*, designed for engagement in corresponding sections of the guide 73*a* (see, for reference, FIG. 41). The slider 66 is moreover configured for coupling with the motion-transmission member 51' of FIGS. 28-29: for this purpose, in the example represented, on the opposite side with respect to the reliefs 66*b*, the slider 66 has a coupling element or front relief 66*c*, designed to be associated or constrained to the member 51', as described hereinafter.

Figure 37:
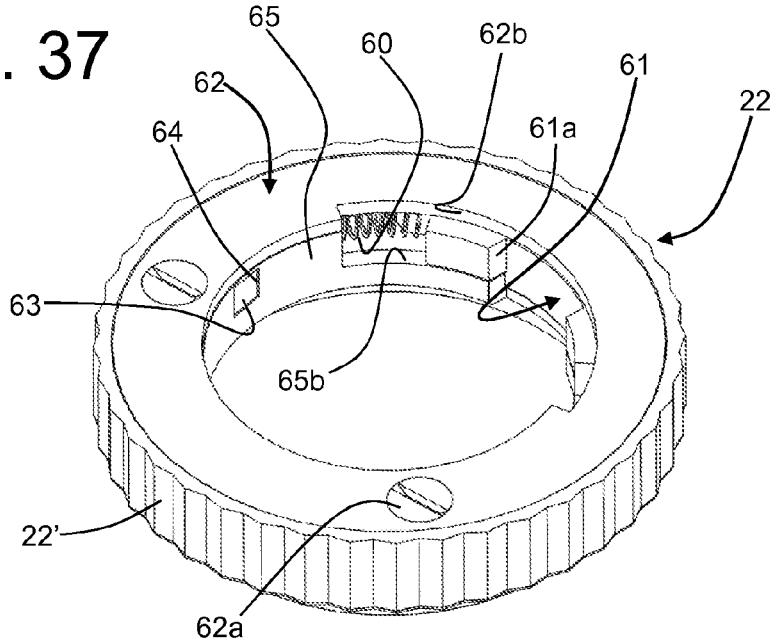
FIGS. 37 and 38 are a perspective view and a partially exploded view of a control means of the device of FIGS. 26-27.
Figure 38:
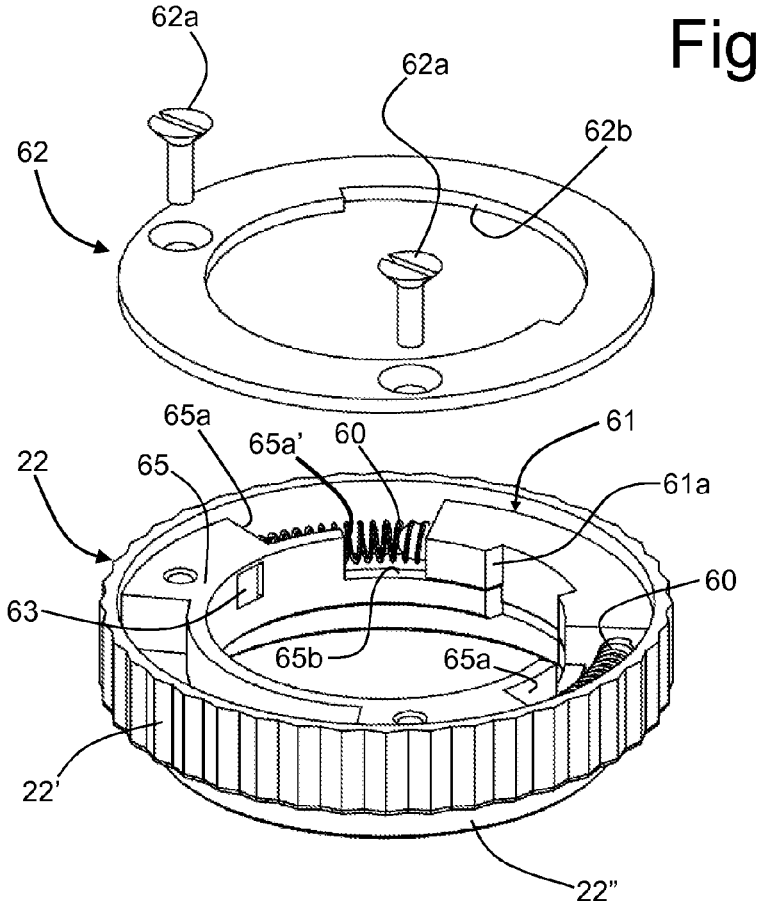

FIGS. 37-38 illustrate the ring nut 22, with the corresponding associated components. In the example, the body of the ring nut, which is, for example, made of plastic material, has a main portion 22', with a preferably knurled outer profile, and a portion of reduced diameter 22", which are both axially hollow. The part 65, which is internal to the portion 22' and has a generally annular or semi-annular shape, defines the seat 64 for the excitation element represented by the magnet 63, as well as two generally opposite housings or seats 65*a*, with a profile at least in part curved according to the outer profile of the ring nut 22. In one embodiment, such as the one represented, the part 65 defines a generally curved housing, set within which is the intermediate element of constraint or slider 61, in this case, the two seats 65 being defined in part at the two opposite ends of the above housing.

The seats 65*a* are designed to receive each the distal end of a respective spring 60. The proximal ends of the two springs 60 are, instead, engaged in respective projections or pins (not indicated) provided at the two opposite ends of the intermediate element 61, the body of which has a generally arched shape, according to the profile of the ring nut 22. As may be noted, then, also the springs 60 have, in the mounted condition, a generally arched development. The intermediate element 61 has, in its internal face, i.e., the one with smaller radius, a seat 61*a* designed for engagement with the contrast element 71*a* of the upright part of the container 40 (see FIG. 32). As may be noted, in particular in FIG. 38, the shaped internal part 65 of the ring nut 22 also defines a resting and sliding surface 65*b* for the element 61 (see, in particular, FIG. 38). The springs 60 are positioned, as may be seen in FIG. 38, preferably in a condition of preloading, with the element 61 set between them, and then on the body of the ring nut 22, the corresponding annular lid 62 is mounted via screws 62*a*, to constrain the springs 60 and the element 61 in the axial direction. In the example, the internal profile of the annular lid 62 has two stretches of different radius, the stretch of greater radius, designated by 62*b*, being provided for enabling angular movement of the ring nut 22 with respect to the fixed contrast element 71*a* referred to previously.

Figure 39:
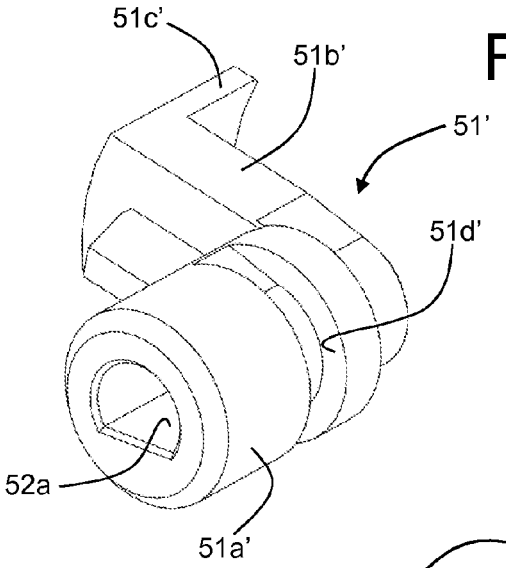
FIGS. 39 and 40 are perspective views, from different angles, of a motion-transmission member of the device of FIGS. 26-27.
Figure 40:
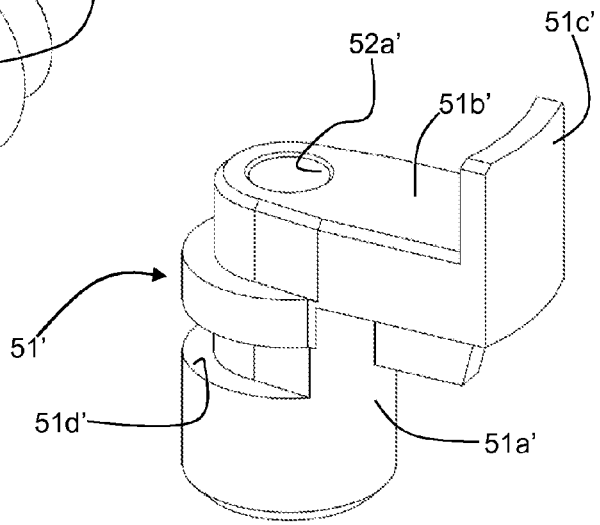
Figure 50:
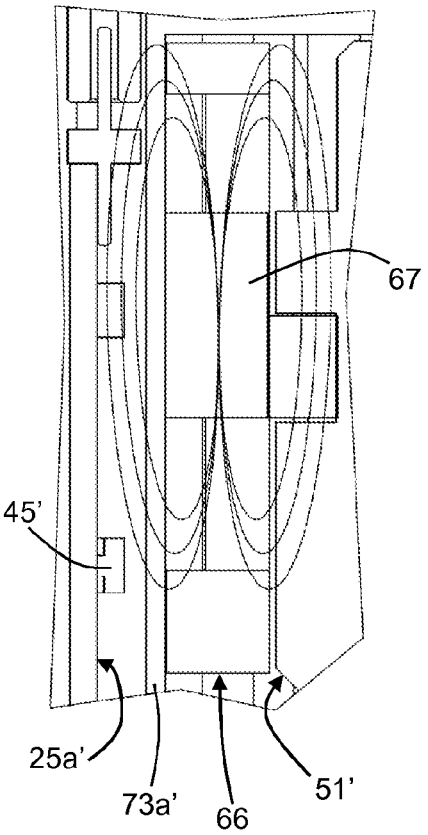
FIGS. 50-51 are two partial and schematic sectional views of the device of FIGS. 26-27, aimed at exemplifying the working principle of a sensor of the device.
Figure 51:
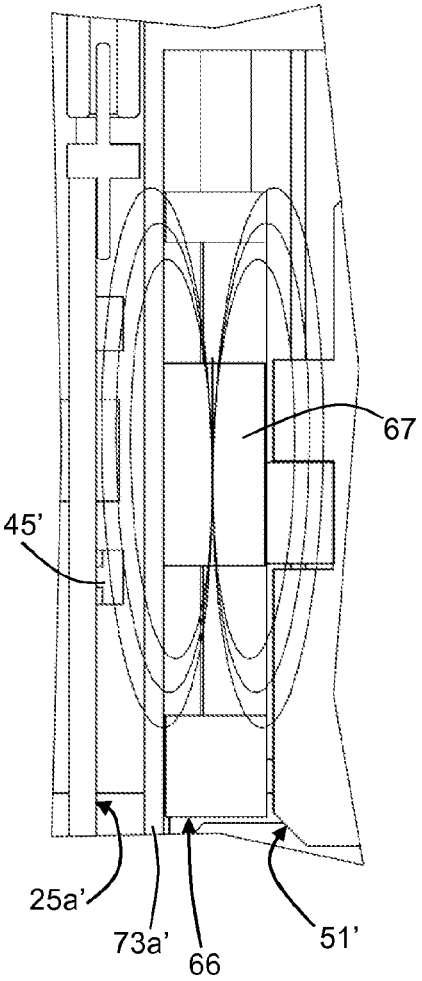

FIGS. 39 and 40 illustrate the motion-transmission element 51', the body of which includes a main axial portion 51*a*' that extends along a corresponding axis, is generally cylindrical, and from the top of which there rises an intermediate radial portion 51*b*', having at the end an appendage 51*c*', which here extends in a direction substantially parallel to the aforesaid axis and has a preferably generally arched cross section. The portion 51*a*' has a central axial passage 52*a*, configured for coupling to the upper end region of the rod 11 of the gas tap. The coupling is substantially complementary, or in any case such that a rotation imparted on the member 51' will cause a rotation of the rod 11 (for example, the rod 11 and the seat 52*a* may have an at least in part semi-cylindrical shape). Preferably, provided on the opposite side of the portion 51*a*' is a second passage or seat, with circular cross section, designated by 52*a*', where a preferably cylindrical appendage, for centring and guide, is to be inserted, the appendage belonging to the upright part 70 of the container 40: such an appendage is designated by 74 in FIGS. 28 and 50 and projects underneath from the bottom wall 72*a* of the upper portion 72 of the upright part 70. The passages 52*a* and 52*a*' are preferably configured as distinct passages, provided with a bottom (see FIG. 49), or else may be defined by one and the same axial passage, provided that the diameter of the part of passage 52*a*' is smaller than the diameter of the rod of the tap; this considering the fact that the motion-transmission member 51' is able to move axially with the shaft 11, when the latter is to be pressed, as described hereinafter.

The axial portion 51*a*' has, in at least part of an intermediate area thereof, a circumferential groove or channel 51*d*'. The height and the depth of said groove are such that there can be engaged therein the front relief 66*c* of the slider 66, with an engagement such that the motion-transmission member 51' may be freely rotated with respect to the slider 66, whereas an axial movement imparted on the member 51' will be transferred to the slider 66.

The arched appendage 51*c*' of the member 51' is designed for separable engagement with the coupling seat 12*d* within the knob 12 (see for reference FIG. 28), in such a way that movements of rotation and/or of axial thrust imparted on the knob 12 are transferred, by means of the motion-transmission member 51', to the rod 11 of the gas tap. As has been said, moreover, an axial movement thus imparted on the member 51' determines a sliding also of the slider 66. Also in this case, the appendage 51*c*' and the seat 12*d* are shaped for enabling, if need be, separation of the knob 12 by from member 12 by exerting a tensile force on the knob.

Figure 42:
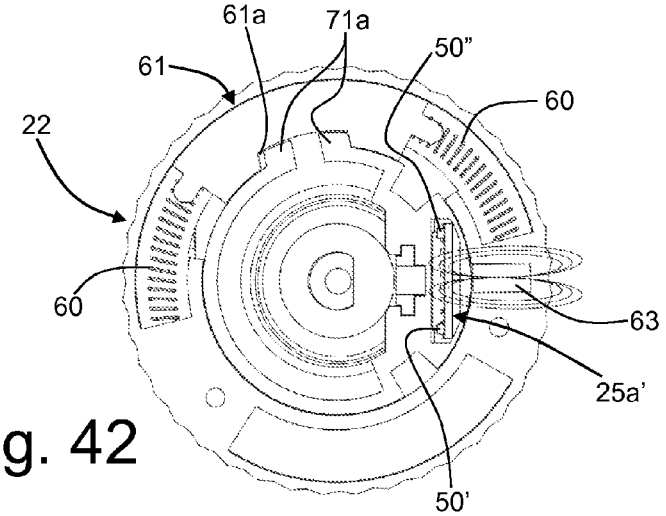
FIGS. 42-44 are sections similar to that of FIG. 41, with a control means of the device in different angular positions.
Figure 43:
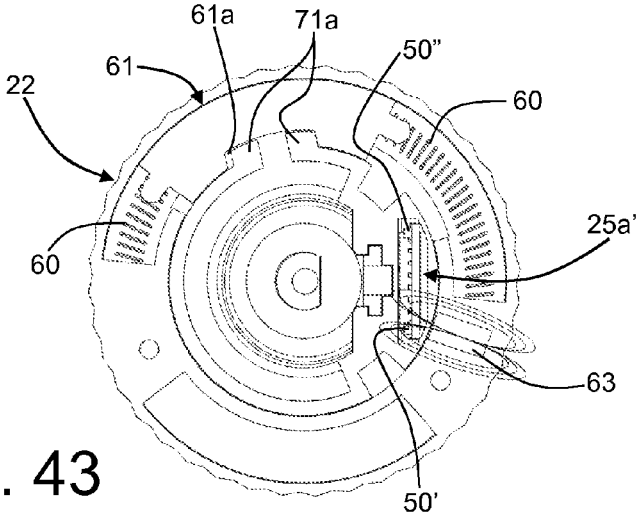
Figure 44:
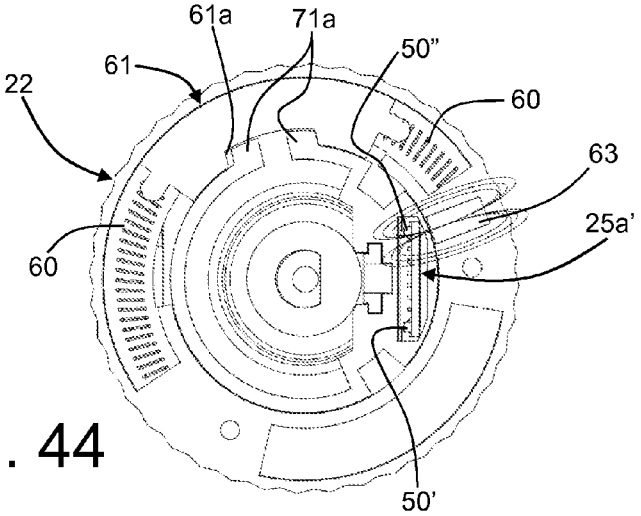

FIG. 41 is a view in cross section according to a horizontal plane passing through the internal part 65 of the ring nut 22. As may be noted, the intermediate element 61 of the ring nut is constrained in a substantially fixed position with respect to the container 40, and especially thanks to the coupling between the contrast element 71*a* of the lower portion 71 of the upright part 70 and the seat 61*a* of the intermediate element. In this way, as may be appreciated, the ring nut 22 can be turned in a clockwise direction and in a counterclockwise direction, but with limited angular movements, the maximum extent of which is substantially determined by the degree of maximum compression allowed for each spring 60 or else by the interference between a wall 65*a*' (FIG. 38) of each seat 65*a* with a respective end of the element 61. Hence, in practice, by turning the ring nut to the right (in a clockwise direction), as viewed in FIG. 41, the left-hand spring 60 will be compressed, whereas the right-hand spring will tend to lengthen, thanks to its own elastic reaction. By then releasing the ring nut 22, the left-hand spring 60 will bring the ring nut back to the initial position, thanks to its own elastic reaction. A similar behaviour, but opposite to what has just been described, is obtained by turning the ring nut 22 to the left (in a counterclockwise direction). FIGS. 42, 43 and 44 illustrate precisely the situations where the ring nut 22 is not turned, is turned to the right, and is turned to the left, respectively.

Moreover visible from FIG. 41 is the passage 73*a* that extends axially in the intermediate portion 73 of the upright part 70 of the container 40, within which the circuit board 25*a*' is at least partially positioned. From this figure there may be clearly noted the wall 73*a*' set between the slider 66 and the circuit board 25*a*' housed within the passage 73*a*, which are thus isolated from one another. Likewise, a wall designated by 73*a*" only in FIGS. 41 and 49—which is generally opposite to the wall 73*a*' and delimits the passage 73*a* on that side—is set between the circuit board 25*a*' and the internal portion of the ring nut 22 where the magnet 63 is located.

The circuit board 25*a*' bears, in two opposite parts of a face thereof, two sensors 50' and 50", which can be excited or energized by the excitation element 63 carried by the ring nut 22. Given that, in the example provided, the element 63 is a magnetic element, the sensors 50' and 50" are magnetic-field sensors, for example Hall-effect sensors.

When the ring nut is in the zero position, i.e., not turned by a user, the magnetic field generated by the magnet 63 does not excite any of the two sensors 50', 50", as exemplified in FIG. 42, where the aforesaid magnetic field is represented schematically via lines of flux. Instead, by turning the ring nut 22 to the right (FIG. 43) or to the left (FIG. 44), the magnet 63 will approach the sensor 50' or the sensor 50", respectively, exciting it. The excitation pulse supplied by the sensor in question is received by the micro-controller MC of the circuit arrangement of the device in order to program the time during which the flame is to remain lit.

The control logic may possibly be prearranged in such a way that by keeping the ring nut constantly rotated, for example to the right, substantially continuous increment of the programming time is obtained, which obviously is displayed and updated constantly on the display module D; instead, by turning the ring nut to the right and then bringing it back (or releasing it) towards its initial position (FIG. 42), a discrete increment of the time is obtained, for example in steps of 30 sec.

In the case where, during setting, the user keeps the ring nut turned, or imparts a number of rotations thereon, until the effectively desired programming time is exceeded, he will simply have to turn the ring nut in a direction opposite to the previous one, to adjust the time decreasing it: as has been said, the time increasing or decreasing in time is preferably shown on the display module D, ensuring ease and precision of setting. It will thus be appreciated that the sensors 50', 50", with the corresponding excitation element 63, basically perform functions similar to the ones of the sensor 50 previously described (in this case, the sensors 50', 50" form the stationary part of the detection system, while the element 63 constitutes the movable part thereof).

To return to FIG. 41, moreover visible partially is the slider 66, inserted in the corresponding guide 73*b*, with the corresponding excitation element 67 generally facing the circuit board 25*a*" inserted in the corresponding passage 73*a*.

The circuit board 25*a*' is provided with a further sensor, designed to interact with the element 67. Also in this case, given that in the example the element 67 is a magnet, the corresponding sensor is a magnetic-field sensor, such as a Hall-effect sensor. This sensor is designated by 45' only in FIG. 49.

As may be seen, in FIG. 49, the magnet 67 is in a position generally set facing the sensor 45' so as to be able to excite it by means of its own magnetic field, notwithstanding the presence of the interposed wall 73*a*', when the knob 12 is pressed. More in particular, when the knob 12 is not pressed, the magnet 67 is located in a position relatively far from the sensor 45' (or in a position centred with respect thereto, so that the lines of magnetic field do not traverse the plane of the sensor) so that the latter is not affected by the magnetic field generated by the magnet itself.

When, instead, the knob 12 is pressed, the motion-transmission member 51' transmits the axial movement to the slider 66, which by sliding in its guide 73*b* approaches the magnet 67 of the corresponding sensor 45', which is thus excited by the magnetic field.

Detection of the magnetic field made by the sensor 45' is interpreted by the control logic as indicating that pressure has been applied on the knob 12: in this perspective, it will be appreciated that the sensor 45', with the corresponding excitation element 67, basically performs functions similar to the ones of the switch 45 described previously. When the knob 12 is released, this will return autonomously to its original position, with consequent de-excitation of the sensor 45'. It should be pointed out that, preferably, the knob 12 defines, at its lower end, an annular seat, designated by 12' in FIGS. 28 and 50, received in which is the portion 22" of the ring nut 22, when the knob itself is pressed.

It will likewise be appreciated that the sensor means for detecting the angular movement of the ring nut 22 and the axial movement of the knob 12 (or of the motion-transmission member 51') may be of some other type, preferably but not necessarily contactless sensors, such as for example sensors of an inductive or optical type.

Figure 45:
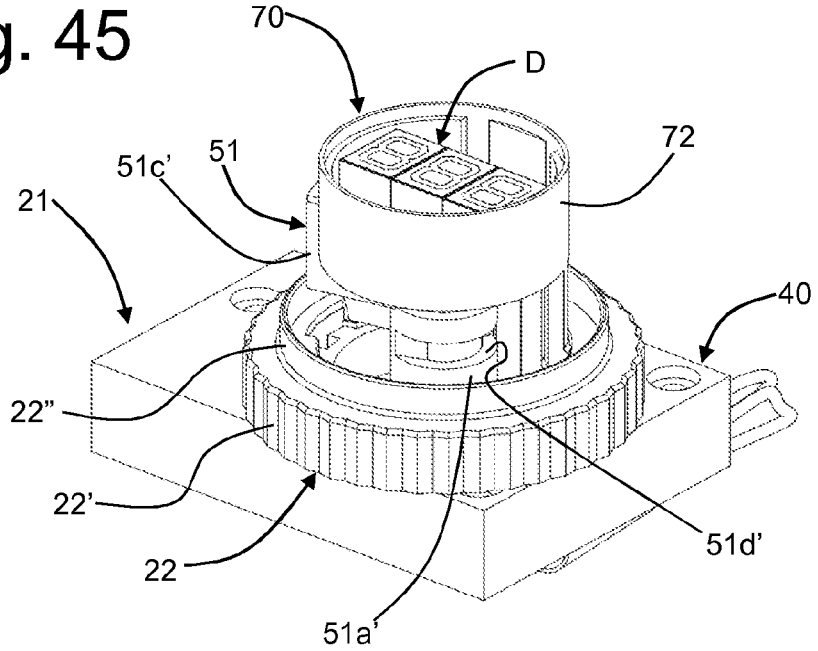
FIGS. 45-47 are partial schematic perspective views, some of which partially sectioned, of the device of FIGS. 26-27.
Figure 46:
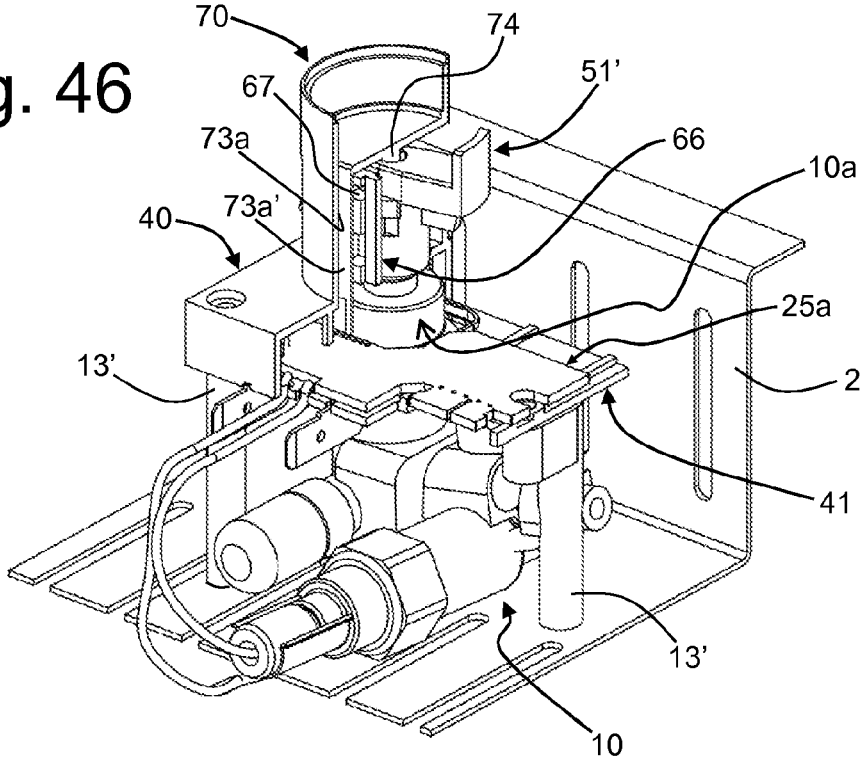
Figure 47:
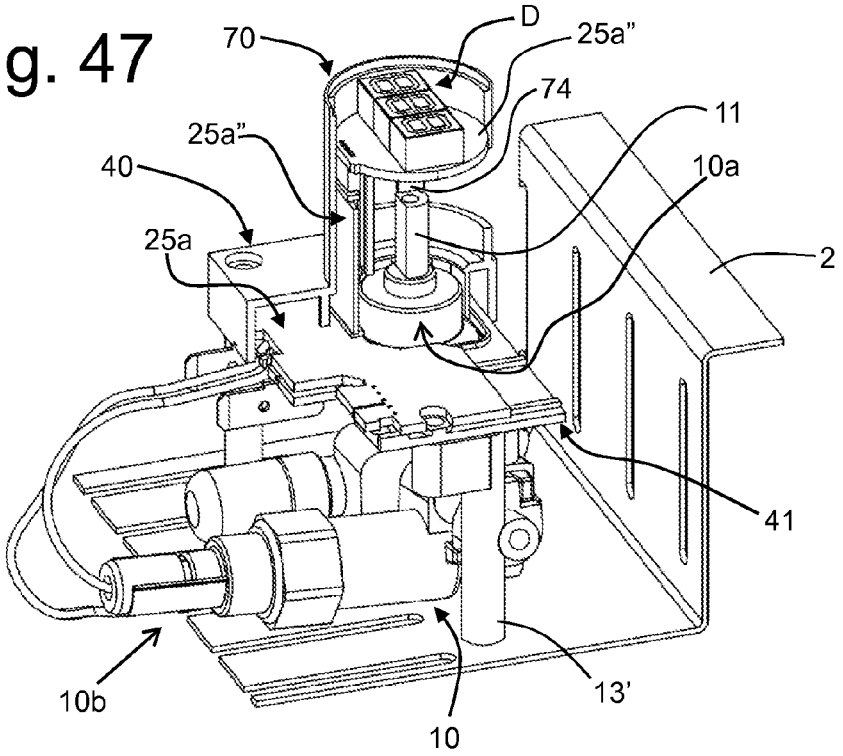

FIGS. 45-47 are schematic illustrations of conditions of partial assembly of the device 20'. In FIG. 45 there may be noted, for example, the module D housed within the cavity of the upper portion 72 of the upright part 70, with the engagement appendage 51*c*' of the motion-transmission member 51 projecting on the outside of the upright part 70 itself, whereas in FIG. 46 the seat 73*a* of the intermediate portion 73 is clearly visible with the slider 66 generally parallel to the aforesaid passage and the interposed wall 73*a*', as well as the head portion 10*a* of the tap 10 partially fitted between the container 40 and the casing 41, with the member 51' mounted on the stem of the tap, here not visible. This stem 11 is visible, instead, in FIG. 47, where the member 51' is instead omitted and the circuit board 25*a*' and the module D are visible. In the case exemplified, the bracket 13 of the first embodiment is here replaced by columnar or tubular supports 13', for fixing to the structure 2 of the appliance for example via screws, such as screws that connect together the lid 41 and the container 40. It will be appreciated, in any case, that also in this embodiment, it is possible to use a metal or plastic bracket, or some other fixing and/or sealing means between the lid 41 and the container 40, as in the previous case.

Figure 48:
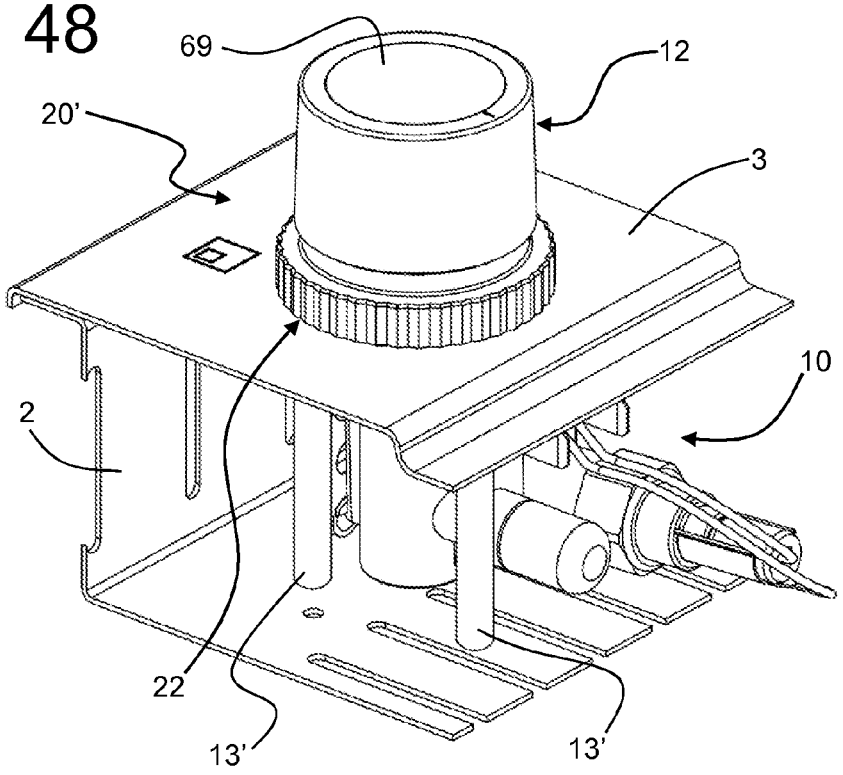
FIG. 48 is a schematic perspective view of the device of FIGS. 26-27 in a condition where it is installed.

FIG. 48 illustrates the complete timer device installed, whereas FIG. 49 highlights a partial cross section thereof, from which there may be appreciated the corresponding position of some of the components previously described. There may be noted, in particular, the positions of the protection lids 68 and 69, respectively of the upper end of the portion 72 of the upright part 70 and of the axially hollow knob 12, as well as the circuit board 25*a*" set in the corresponding passage 73*a*. The protection lid 68 preferably envisages a non-transparent part and transparent parts, where at least one substantially rectangular central transparent part is associated to the display D; in the example, other circular transparent parts are also provided, which can be associated to possible LEDs (not represented), provided on the circuit board 25*a*". As emerges, the two lids 68 and 69 are at a certain distance from one another so as to enable axial movement of the knob 12 when this is pressed (with consequent approach of the lid 69 to the lid 68).

Use of the device 20' is according to modalities similar to the ones previously described, with the sensors 50', 50" and the magnet 63 that perform the functions of the potentiometer 50 and with the sensor 45' and the magnet 67 that perform the functions of the switch 45 and of the corresponding motion-transmission element 27. What changes, as has been said, are the practical modalities of setting of the time by the user, who in this case has to enable modest and/or repeated angular movements of the ring nut 22.

In this embodiment, angular movement in one direction of the ring nut 22 will correspond to an increment of the programming time, whereas angular movement in the opposite direction will correspond to decrement of the time, with corresponding indications appearing on the display D: however, as compared to the first embodiment, in this case the control logic is such that the programming time is not incremented/decremented in a way proportional to the angular movement imparted on the ring nut 22, but in a way substantially proportional to the time during which the ring nut itself is kept angularly displaced in one direction or in the other with respect to the inoperative position of FIG. 42 (basically, as if a pushbutton "+" or a pushbutton "−" were pressed, respectively).

As may be seen, in the embodiment exemplified, the sensor means for detecting movement of the knob 12 include excitation means—here represented by the magnet 67—, which are separated or isolated from the detection means—here represented by the magnetic sensor 45'—by sealing or isolation means—here represented by the interposed wall 73*a*'. Similar considerations apply for the sensor means for detecting movement of the ring nut 22, with the corresponding excitation means 63, detection means 50', 50", and sealing, means 73*a*". As has been said, the contactless sensor means used might even be different from magnetic-sensor means; for example, they may be of an type optical (in which case the walls 73*a*'; 73*a*" could be at least in part transparent and/or provided with windows in positions such as to enable excitation of the optical-sensor means according to when the knob and/or the ring nut are/is brought into the positions of interest).

It will be appreciated that, in different embodiments, the ring nut 22 of the device 20' could also be replaced by two pushbuttons, of which one (for example, bearing a button marked by "+") for incrementing the time and the other (for example bearing a button marked by "−") for decrementing the time during setting. These buttons could be conveniently mounted in a stationary position, close to the display D so as to be operable from the front of the knob 12, the lid 69 of which will be conveniently shaped for this purpose. The aforesaid buttons do not necessarily have to be of a mechanical type, it being possible for them to include, for example, capacitive sensors, in particular capable of feeling the presence of a finger of a user without the need for mechanical parts in motion, even with the protection 69 set in between. The pushbuttons referred to above could also be replaced by a small lever that can be operated angularly in opposite directions, or by a slider that can be actuated linearly in opposite directions, with a corresponding potentiometer associated thereto.

Assembly of the device 20' is relatively simple. The circuit board 25*a* is positioned in the cavity of the container 40 and the circuit board 25*a*' in the corresponding passage 73*a* of the upright part 70. As has been said, electrical coupling between them may be conveniently obtained via multipolar fast-coupling connectors or soldering. The same may be said for the connection between the circuit board 25*a*' and the circuit board 25*a*" of the display D, with the latter that is positioned in the cavity of the upper portion 72 of the upright part 70. The pre-assembled ring nut 22 is fitted on the upright part 70 until engagement of the seat 61*a* of the intermediate element 70 with the contrast element 71*a* of the lower portion of the upright part itself is obtained. The slider 66 bearing the magnet 67 is inserted from beneath in the corresponding guide 73*b*, after which the lid 41 can be applied to the container. The head part 10*a* of the tap is then fitted in the passage 42 of the casing 21, defined in part by the opening 41*a* of the lid 41 and in part by the tubular portion 42*a* and by the upright part 70 of the container 40. In the course of this insertion, coupled on the rod 11 of the tap is the motion-transmission member 51', positioned (thanks also to the coupling between the passage 52*a*' and the lower projection 74 of FIG. 28) so that the front relief 66*c* of the slider 66 is engaged in its groove 51*d*'. Then, after application of the transparent lid 68 to the top of the upright part 70, fitted on the latter is the knob 12 with the corresponding transparent lid, with its internal seat 12*d* that couples to the appendage 51*c*' of the motion-transmission member 51'.

Preferably, the casing body of the device has a structure that is substantially hermetically sealed, or in any case such as to prevent any infiltration of dirt or water, for example during the operations of cleaning of the appliance 1, for example the ones carried out after removing the knob 12. For this purpose, the seats or chambers that house the various circuit boards are preferably protected in a sealed way.

The type of embodiment of the ring nut 22, as well as the modalities of detection of the displacements of the ring nut 22 itself and of the knob 12, based upon contactless-sensor means, are extremely advantageous to employ for a user, in particular in combination with a display device. These embodiments and modalities are on the other hand to be considered as being independently inventive and applicable also to the case of a timing device provided with a display separate from the knobs 12 (for example, a common panel display as in WO2010134040) and possibly also in the case of timer devices without a display device.

It is clear that numerous variations may be made by a person skilled in the art to the device described by way of example, without thereby departing from the scope of the invention as defined in the annexed claims. The various characteristics of the various examples may be combined at least in part together to form devices that may even be different from the ones represented and described by way of non-limiting example herein.

In embodiments previously exemplified, to one and the same control element 45; 45' there may be associated both activation of the lighter system, and the functions of the device 20 linked to timing, but it is clear that even a number of control elements may be provided, such as two separate contacts or switches. In such a variant, for example, the control element associated to timing may be switched via the ring nut 22, which in this case will be mounted axially movable. As already mentioned, moreover, the timer device may not perform functions linked to lighting of the burner.

Previously, reference has been made to the use of control means, amongst which the switch Q1,designed to modify the state of the electrical connection between the electrical-connection means 47 and 25*d*, i.e., to open the thermocouple-solenoid electrical circuit when the time interval set via the ring nut 22 has elapsed. As already mentioned, according to possible variants, the control means may be prearranged for modifying the state of the connection referred to above, without necessarily opening the aforesaid circuit, but simply by varying it (for example, by inserting in parallel to the thermocouple a load or a resistance that reduces the current to the solenoid).

According to a variant (not represented), the magnet 67 or other excitation element that performs the functions thereof is separate from the slider 66, albeit associated to and moved by the slider itself: in such a variant, for example, the magnet is inserted movable in an appropriate seat of the casing 40 (for example, similar to the guide 73*b*) and is forced by a spring or other elastic means towards a predefined position, of non-excitation of the sensor means 45'. In such an embodiment, the magnet 67 is moved by the slider 66 countering the elastic reaction of the spring for energizing the sensor means 45' when the knob 12 is pressed, with the spring that then brings the magnet back into its original position when, following upon release of the knob, also the slider returns to the corresponding initial position.

The second part of structure 43, 44; 70 can be prearranged to provide functions of optical guide, for example by making it of transparent material or in any case a material capable of transmitting visible radiation, combined or otherwise with a display or some other warning means.

The invention claimed is:

1. A gas appliance control device, in particular for appliances that comprise at least one gas tap having a safety valve that includes an electromagnet that can be supplied via a thermo-electric generator, the control device comprising:

manual-control means; and circuit arrangement that includes:

control means;

electrical-interconnection means;

detection means, configured for detecting actuation of the manual-control means and supplying corresponding signals to the control means; and a supporting structure, which can be associated in a stationary way with respect to a gas tap, wherein the supporting structure includes a first part of stationary structure that defines a housing for at least part of the circuit arrangement, the first part of structure being in particular designed for being housed within a body of the gas appliance, wherein the control means are designed for counting the time and the circuit arrangement includes display means, said device being characterized in that the supporting structure includes a second part of stationary structure associated to or projecting from the first part of stationary structure and configured for housing or supporting the display means in a fixed or not angularly rotatable position, where in particular, in an installed condition of the device, the second part of structure projects on the outside of the body of the gas appliance.

2. The device according to claim 1, wherein:

the manual-control means comprise first control means, that can be actuated by a user for setting a time interval;

the detection means comprise first detection means, configured for detecting actuation of the first control means;

the interconnection means comprise first electrical-connection means, configured for connection to an electromagnet of a safety valve, and second electrical-connection means, configured for connection to a thermo-electric generator;

and wherein the control means are configured for modifying the state of an electrical connection between the first electrical-connection means and the second electrical-connection means upon expiry of the aforesaid time interval.

3. The device according to claim 1, wherein the manual-control means comprise second control means configured for mechanical connection to a control rod of the gas tap, the second control means including a knob defining a cavity, housed at least partially in which is at least one of the second part of structure and the display means, the knob being angularly rotatable with respect to the second part of structure and to the display means and preferably having a front opening or window, and wherein the detection means comprise second detection means, configured for detecting actuation of the second control means.

4. The device according to claim 3, wherein the second control means comprise a motion-transmission member for mechanical connection of the knob to said rod, the motion-transmission member including first coupling means, for coupling with said rod, and second coupling means, for coupling with respective coupling means of the knob, the motion-transmission member preferably including also third coupling means for coupling with respective coupling means of the second part of structure.

5. The device according to claim 1, wherein the control means are configured for controlling the display means for indicating at least one from among:

a residual time, i.e., a time remaining until expiry of said time interval;

a progressive time, i.e., a total time elapsed starting from ignition of a flame; and a condition of ignition/quenching of a flame;

where in particular, the display means comprise character-display means.

6. The device according to claim 1, wherein the second part of structure supports or houses at least part of the circuit arrangement, in particular at least one of electrical-connection means of the display means, a circuit board of the circuit arrangement, and at least part of the detection means for detecting a movement of the manual-control means.

7. The device according to claim 2, wherein the first control means include a member movable in opposite directions, in particular countering elastic means that are operative for urging the movable member into a predefined position.

8. The device according to claim 2, wherein the first control means include a ring nut member operable angularly in opposite directions, countering elastic means that are operative for urging the ring nut member into a predefined intermediate angular position, in an installed condition of the device the ring nut member and a knob coupled to the gas tap being substantially coaxial and the second part of structure having at least one respective stretch passing through an axial cavity of the ring nut member.

9. The device according to claim 8, wherein the ring nut member comprises a first part associated in a stationary way to the supporting structure, a second part associated in a movable way to the first part, and elastic means operatively set between the first part and the second part, where in particular the first part has two generally opposite end regions, the second part defines two generally opposite contrast elements, and the elastic means comprise a first elastic means operatively set between one said end region and one said contrast element, and a second elastic means operatively set between the other said end region and the other said contrast element.

10. The device according to claim 7, wherein the first detection means comprise a first sensor means for detecting a rotation in a first direction of the movable or ring nut member with respect to said predefined position and a second sensor means for detecting a rotation in a second direction of the movable or ring nut member with respect to said predefined position, where in particular the movable or ring nut member has associated thereto at least one excitation element that is able to exciting the first sensor means and the second sensor means following upon a rotation of the movable or ring nut member in the first direction and in the second direction, respectively, the sensor means being preferably contactless sensors, very preferably magnetic-field sensor means.

11. The device according to claim 3, wherein the second detection means are prearranged for detecting an axial movement of the knob and are in particular contactless detection means.

12. The device according to claim 11, wherein the second detection means comprise a sensor means in a stationary position and a corresponding excitation element constrained for translating in a generally axial direction of the second part of structure, the excitation element being mechanically connected to the knob, in particular at least by way of said motion-transmission element.

13. The device according to claim 12, wherein the second part of structure comprises a guide for constraining the translation of the excitation element in said generally axial direction of the second part of structure.

14. The device according to claim 11, wherein the second detection means comprise a slider element, associated to which is an excitation element, the slider element being preferably slidably engaged in a guide and constrained to the motion-transmission member, in particular with a coupling that is designed to transfer an axial movement of the motion-transmission member to the slider element enabling at the same time rotation of the motion-transmission member with respect to the slider element.

15. The device according to claim 1, wherein the second part of structure defines an axial seat or cavity, housed within which is at least part of the circuit arrangement.

16. The device according to claim 1, wherein the first part of structure defines at least part of a passage or seat, in which there may be received a corresponding part of the gas tap.

17. The device according to claim 1, wherein the second part of structure:

is configured for supporting the display means in a position generally set facing and/or coaxial to a passage of the first part of structure, in which there may be received a corresponding part of the tap and/or in a position at a distance from said passage; and/or the second part of structure comprises at least one from among:

a supporting wall for the display means, which is preferably generally parallel to a front of the first part of structure, a connection wall that extends between the first part of structure and a supporting wall for the display means, a supporting wall for the display means that is substantially set in cantilever fashion with respect to a connection wall that starts from the first part of structure.

18. A gas appliance, in particular a household appliance, comprising a control device according to claim 1, wherein the appliance comprises at least one gas tap for control of the gas supply to a burner, the appliance having a body, partially housed within which is the gas tap, the body having at least one passage at the gas tap, wherein the first part of structure of the control device is housed within the body, with the second part of structure that projects on the outside of the body through the aforesaid passage, where in particular the second part of structure:

traverses and/or is at least in part housed within the aforesaid passage;

extends at least in part coaxial and/or parallel to a control shaft of the gas tap; and comprises a first axial portion that traverses the aforesaid passage and a second portion set in cantilever fashion.

* * * * *